US009554637B2

(12) United States Patent
Marx et al.

(10) Patent No.: US 9,554,637 B2
(45) Date of Patent: Jan. 31, 2017

(54) LOAD BEARING SUSPENSION SYSTEM

(71) Applicant: Vista Outdoor Operations LLC, Clearfield, UT (US)

(72) Inventors: Thomas A. Marx, Virginia Beach, VA (US); Eric M. Yeates, Virginia Beach, VA (US); Charles E. Buis, III, Virginia Beach, VA (US); Scott V. Ferros, Virginia Beach, VA (US); Zac West, Seatle, WA (US)

(73) Assignee: VISTA OUTDOOR OPERATIONS LLC, Clearfield, UT (US)

( * ) Notice: Subject to any disclaimer, the term of this patent is extended or adjusted under 35 U.S.C. 154(b) by 0 days.

(21) Appl. No.: 14/952,981

(22) Filed: Nov. 26, 2015

(65) Prior Publication Data

US 2016/0081461 A1 Mar. 24, 2016

Related U.S. Application Data

(63) Continuation-in-part of application No. 12/736,458, filed as application No. PCT/US2009/002238 on Apr. 8, 2009, now abandoned.

(60) Provisional application No. 61/123,336, filed on Apr. 8, 2008.

(51) Int. Cl.

| | |
|---|---|
| ***A45F 3/14*** | (2006.01) |
| ***A41D 13/00*** | (2006.01) |
| *A41F 9/00* | (2006.01) |

(52) U.S. Cl.

CPC ..... *A45F 3/14* (2013.01); *A41D 13/0007* (2013.01); *A41D 13/0012* (2013.01); *A41F 9/00* (2013.01); *A45F 2003/144* (2013.01); *A45F 2003/146* (2013.01); *A45F 2003/148* (2013.01); *A45F 2200/0591* (2013.01)

(58) Field of Classification Search

CPC ..... A41F 3/00; A41F 15/00; A41F 15/02; A41F 19/00; F41H 1/02; A45F 3/14

USPC ..... 2/44, 45, 310, 326–328, 455

See application file for complete search history.

(56) References Cited

U.S. PATENT DOCUMENTS

| | | | | |
|---|---|---|---|---|
| 4,923,105 A * | 5/1990 | Snyder | A45F 3/14 224/232 |
| 5,909,802 A * | 6/1999 | Puco | A45F 3/04 2/102 |
| 2006/0005293 A1* | 1/2006 | Frey | A44B 11/006 2/44 |
| 2006/0206986 A1* | 9/2006 | Straiton | A41D 1/08 2/238 |

* cited by examiner

*Primary Examiner* — Katherine Moran

(74) *Attorney, Agent, or Firm* — Christensen Fonder P.A.

(57) ABSTRACT

A load bearing and/or suspension system, having a harness element; harness straps extending from the harness element; a pair of suspension members, wherein each suspension member extends from a pair of harness straps; a ladder lock buckle attached or coupled to each suspension member; a pair of webbing segments, wherein a free end of each webbing segment interacts with one of the ladder lock buckles such that when the free end of the webbing segment is urged away from the ladder lock buckle, a second end of the webbing segment is drawn toward the ladder lock buckle; and a belt attachment element attached or coupled to the second end of the webbing segment.

18 Claims, 44 Drawing Sheets

RETRACTED

EXTENDED

LOAD BEARING SUSPENSION SYSTEM

CROSS-REFERENCE TO RELATED APPLICATIONS

This patent application is a Continuation-in-Part of Ser. No. 12/736,458, filed May 27, 2011, which is a U.S. National Stage under 35 USC 371 of International Application No. PCT/US09/02238, filed Apr. 8, 2009, which claims the benefit of U.S. Patent Application Ser. No. 61/123,336, filed Apr. 8, 2008, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to load bearing and/or suspension systems. In particular, the present disclosure relates to an ergonomic load bearing and/or suspension system.

2. Description of Related Art

Military personnel, law enforcement officers, and other workers have traditionally carried most of the essential tools of their trade on their belts. Duty/tool belts, and the weight and shape of the equipment carried on them, not only cause discomfort and fatigue to the wearers wearing them, but over the years of the wearer's career often cause chronic physical problems, including serious back, leg, hip, and nerve ailments.

The duty/tool belt that provides the foundation on which the wearer's tools are supported has traditionally been a heavy, rigid, leather belt, with a large metal buckle. The better leather belts are made of two layers of leather, glued, and stitched tightly together, to increase the belt's stiffness for the purpose of supporting the items it must carry.

In order to provide some support for the weight of the equipment, duty/tool belts are often attached to the wearer's trousers belt beneath it by several "keepers" spaced at intervals around the belt. These keepers are leather or synthetic straps, typically ½" to ¾" wide, that are placed around both the duty/tool belt and the trousers belt beneath it, after which the keeper is fastened into a closed loop either with two metal snaps or with Velcro to hold the two belts together and thus restrict the duty/tool belt's movement on the wearer's waist.

Alternatively, duty/tool belts are sometimes made with hook-and-loop ("Velcro") material on their underside, to attach them, without keepers, to a trousers belt faced with corresponding Velcro material.

The paramount purpose of the duty/tool belt is, of course, to allow the wearer to carry his or her most important items of equipment in a manner that will make them both secure, and readily accessible when needed.

As an example, a typical police officer's "duty belt," as it is called, often supports from 10 to as much as 20 pounds or more of equipment, typically including a semi-automatic pistol in a heavily-constructed, rigid duty/tool holster, a magazine pouch with two spare pistol magazines containing 12-18 rounds of ammunition each, one or sometimes two pairs of handcuffs, a radio with batteries, a baton (solid or expandable), a flashlight, pepper spray, rubber gloves in a glove case, and possibly a Taser, spare Taser cartridges, a cell phone, a duty/tool knife with glass breaker and seat-belt cutter, a citation book (at least for the foot patrol wearer), keys, and other items.

The result of having a significant amount of equipment and/or weighty tools suspended or attached to a duty/tool belt is that all of the considerable weight of the duty/tool belt presses downward on the wearer's hips. Depending on the wearer's physique, physical condition, the material and construction of the belt itself, the equipment carried on it, and the nature of the wearer's job description, the heavy duty/tool belt presses down hard on the wearer's hips, and, as it does, it constricts the wearer's lower back and presses on sensitive nerves. Some wearers find their belts constantly sliding downward over their hips, requiring them to tug the belt back up again and again throughout their work day.

Tightening the belt in an attempt to keep it from sliding down increases the discomfort to the wearer's back, hips, and nerves. The tight belt sometimes causes equipment or equipment pouches to bite into the wearer's hip, or to aggravate the nerves running over the hip.

Typically, the military and law enforcement communities place a high value on tradition and radical changes in uniform design are slow in coming. Generally, the sharp, neat appearance of uniformed personnel and officers is of great importance, and even a minor deviation from the unit's or agency's dress code can subject the wearer to reprimand or discipline. In the past, at least some agencies were so insistent on the uniform appearance of their uniformed officers that they went so far as to require all officers to wear their holsters on the same side, regardless of whether the wearer was right-handed or left-handed.

While such an extreme demand for consistency may now be largely a thing of the past, it is evident that any major deviation from a traditional uniformed military, law enforcement, and other appearance, such as wearing externally-visible suspenders, an equipment vest, or a uniform shirt with equipment pouches sewn into it, would be unacceptable to most military, law enforcement, and other agencies, and thus would not offer a practical solution to the duty/tool belt's physical problems for the majority of wearers who suffer-or will sooner or later suffer-from physical problems as a result of wearing a traditional duty/tool belt.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

SUMMARY OF THE INVENTION

The present disclosure relates generally to load bearing and/or suspension systems. In particular, the present disclosure relates to an ergonomic load bearing and/or suspension system.

In order to alleviate the discomfort, fatigue, and chronic physical problems suffered by many military personnel, law enforcement officers, and others as the result of the weight of their equipment laden duty/tool belts pressing on their hips, nerves, and lower backs, the present disclosure relates to a suspender system that transfers at least some of the duty/tool belt's weight to the wearer's shoulders, relieving weight and pressure on the wearer's lower back and hips.

In various exemplary, non-limiting embodiments, the load bearing and/or suspension system optionally comprises an over-the-shirt system, which incorporates a visible or partially visible suspenders load bearing and/or suspension system. Alternatively, the load bearing and/or suspension system of the present disclosure comprises an under-the-shirt system, which comprises a non-visible or only minimally visible, non-suspender load bearing and/or suspension systems.

In various exemplary, non-limiting embodiments, an optional shirt, or other overgarment, is formed so as to accommodate the load bearing and/or suspension system instead of actually being the load bearing and/or suspension system. The shirt or overgarment provides a more traditional appearance with non-traditional materials and construction. The shirt or other overgarment may also be formed so as to accommodate conventional or concealed soft armor.

In various additional exemplary, non-limiting embodiments, the load bearing and/or suspension system is applied the shirt or overgarment itself and/or to externally worn hard or soft armor.

In various additional exemplary, non-limiting embodiments, the load bearing and/or suspension system is applied external tactical armor/vests.

A typical shirt or other overgarment may be retrofitted to accommodate the load bearing and/or suspension system of the present disclosure. For example, an existing duty shirt may be modified to include iron-on patches and cut opening. Thus, a wearer may take a current in-use shirt and make a simply alteration to employ this new system.

In certain exemplary, non-limiting embodiments, the system duty shirt may be modified to incorporate longer zipper access to reach in for adjusting the adjustment dial. In certain exemplary, non-limiting embodiments, the shirt or other overgarment may include a substantially flat interior pocket in this opening where a wearer could keep important personal items, such as, for example, identification cards.

It should be appreciated that the shirt or overgarment itself may have ballistic properties.

In certain exemplary, non-limiting embodiments, an optional overgarment may comprise a vest, either a tactical-type vest or an external vest. The vest may optionally include a zippered front as well as certain side protection and fitted patterning.

Alternatively, the vest may be constructed so as to provide increased flexibility for a custom fit. In still other exemplary, non-limiting embodiments, the vest can combine a zippered front with a degree of modular dexterity.

In various exemplary, non-limiting embodiments, an adjustment dial is optionally positioned within the load bearing and/or suspension system in order to allow the system to be adjusted for each individual wearer. While an adjustment dial may be utilized, any device capable of retracting appropriate section(s) of the load bearing and/or suspension system may be utilized.

The adjustment dial may be manually manipulated to extend or retract portions of the load bearing and/or suspension system. Alternatively, the adjustment dial may allow for auto-retraction and/or tensioning of the components of the load bearing and/or suspension system.

In various exemplary, non-limiting embodiments, the adjustment dial, or other retracting device, is attached or coupled to a suspender-type portion of the load bearing and/or suspension system. Alternatively, the adjustment dial, or other retracting device, maybe attached coupled to a belt portion of the load bearing and/or suspension system.

In various exemplary, non-limiting embodiments, improvements are optionally made to a pair of trousers as well. In various exemplary, non-limiting embodiments, the trousers and body a traditional appearance, but allow for improved performance. In other exemplary, non-limiting embodiments, the appearance of the trousers is modified to provide for even better performance.

In various exemplary, non-limiting embodiments, optional improvements are made to a duty/tool belt. While maintaining a relatively traditional appearance, the improved the duty/tool belt is constructed using extremely non-traditional elements and/or components.

In various exemplary, non-limiting embodiments, the duty/tool belt optionally includes an overmolded portion. The overmolded portion may be included along at least an area of the upper and/or lower edge of the belt, in an area proximate the right and left hip bone areas of a wearer.

The duty/tool belt may be constructed so as to include at least some interfacing loops for the harness structure to support the belt. Alternatively, interfacing loops may be appropriately secured around a more traditional duty/tool belt.

In various exemplary, non-limiting embodiments, the load bearing and/or suspension system optionally includes a holster or other pouch or carrier. The holster, pouch, or carrier allows for improved positioning, carrying angles, and/or carry heights. In various exemplary, non-limiting embodiments, the holster, pouch, or carrier is able to be attached or coupled to certain elements of the load bearing and/or suspension system of the present disclosure.

In various exemplary, non-limiting embodiments, certain methods of attachment are optionally provided for proper utilization of the load bearing and/or suspension system.

Thus, the load bearing and/or suspension system can be a stand-alone system; can be worn over a shirt, a shirt-like overgarment, and/or vest; can be formed as an integral part of a shirt, a shirt-like overgarment, and/or vest; and/or can be part of a combined body armor carrier and load bearing and/or suspension system.

In various exemplary embodiments, an optional Velcro adjustable version of the load bearing and/or suspension system is similar to the adjustment dial version, except that instead of the adjustment dial, the system utilizes Velcro-controlled gross adjustments in the nylon straps that pass down from the right and left shoulder harnesses, combined with plastic adjustment buckles that permit the straps to be shortened or lengthened several inches to allow fine adjustments to be made by accessing the strap ends through the slots in the modified uniform shirts.

In various exemplary embodiments, optional plastic buckles are quickly detachable by the user, by means of a glove-compatible pinch-to-release design. The simplicity and less mechanical nature of the Velcro strap adjustable system can be more reliable in extended field use and under adverse conditions.

It should be appreciated that with an optional adjustment dial or an optional Velcro adjustment system, the user has the option of determining how much of the duty/tool belt's weight he or she transfers off the hips and waist, and onto the shoulders. Slack in the load bearing and/or suspension system will leave all or almost all of the weight and pressure on the wearer's hips and waist, while a tight load bearing and/or suspension system can transfer virtually all of the duty/tool belt's weight to the wearer's shoulders. Individual users may prefer to adjust the ratio based on their own comfort, physical condition, or the nature of activity in which they are engaged. Analogizing the load bearing and/or suspension system to a backpack with shoulder straps and a hip belt, the user may also wish to tighten and loosen the load bearing and/or suspension system from time to time during the day, to give either his shoulders or his hips a rest by temporarily transferring more of the weight to the other part of his body.

While traditional uniform-style shirts can easily and inexpensively be modified to permit the use of the load bearing and/or suspension system, the load bearing and/or suspension system can optionally be used with unconventional uniform shirts, such as bike patrol shirts and golf-type shirts. Other types of shirts can be modified to permit the use of load bearing and/or suspension system of this design as well.

In various exemplary embodiments, the load bearing and/or suspension system comprises a harness element; harness straps extending from the harness element; a pair of suspension members, wherein each suspension member extends from a pair of harness straps; a ladder lock buckle attached or coupled to each suspension member; a pair of webbing segments, wherein a free end of each webbing segment interacts with one of the ladder lock buckles such that when the free end of the webbing segment is urged away from the ladder lock buckle, a second end of the webbing segment is drawn toward the ladder lock buckle; and a belt attachment element attached or coupled to the second end of the webbing segment.

Accordingly, various exemplary, non-limiting embodiments of the present disclosure separately and optionally provide a load bearing and/or suspension system of improved design.

Various exemplary, non-limiting embodiments of the present disclosure separately and optionally provide a load bearing and/or suspension system, which is capable of accommodating and/or allowing for non-traditional equipment placement.

Various exemplary, non-limiting embodiments of the present disclosure separately and optionally provide a load bearing and/or suspension system, which is capable of being used in conjunction with all kinds of undershirts as well as with various armor carriers.

Various exemplary, non-limiting embodiments of the present disclosure separately and optionally provide a load bearing and/or suspension system, which is not dependent on any kind of internal carrier.

Various exemplary, non-limiting embodiments of the present disclosure separately and optionally provide a load bearing and/or suspension system, which provides a better overall distribution of the weight that results from conventionally carried duty gear.

Various exemplary, non-limiting embodiments of the present disclosure separately and optionally provide a load bearing and/or suspension system, which is capable of accommodating both male and female wearers, as well as wearers of various body types, physical condition, disabilities, and/or skill levels.

Various exemplary, non-limiting embodiments of the present disclosure separately and optionally provide a load bearing and/or suspension system, which allows improved freedom of movement for a wearer.

Various exemplary, non-limiting embodiments of the present disclosure separately and optionally provide a load bearing and/or suspension system, which does not need to be removed during certain activities, such as, for example, while the wearer is using a toilet.

Various exemplary, non-limiting embodiments of the present disclosure separately and optionally provide a load bearing and/or suspension system, which is constructed so as to avoid nerve damage often associated with military, law enforcement, and others and other belt-wearing tradesmen.

Various exemplary, non-limiting embodiments of the present disclosure separately and optionally provide a load bearing and/or suspension system, which is capable of being utilized with a conventional-looking but wrap-around-securing shirt.

Various exemplary, non-limiting embodiments of the present disclosure separately and optionally provide a load bearing and/or suspension system, which provides improved comfort and reduction of fatigue to those wearing equipment-laden duty/tool belts.

Various exemplary, non-limiting embodiments of the present disclosure separately and optionally provide a load bearing and/or suspension system, which may reduce the incidence and/or severity of physical ailments commonly associated with the long-term wearing of duty/tool belts.

These and other features and advantages of the present disclosure are described in or are apparent from the following detailed description of the exemplary, non-limiting embodiments.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY, NON-LIMITING EMBODIMENTS

For simplicity and clarification, the design factors and operating principles of the load bearing suspension system according to the present disclosure are explained with reference to various exemplary, non-limiting embodiments of a load bearing suspension system according to the present disclosure. The basic explanation of the design factors and operating principles of the load bearing suspension system is applicable for the understanding, design, implementation, and operation of the load bearing suspension system of the present disclosure.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "load bearing and/or suspension system", "suspender", and "non-suspender" are used for basic explanation and understanding of the operation of the systems, methods, and apparatuses of the present disclosure. Therefore, the terms "load bearing and/or suspension system", "suspender", and "non-suspender" are not to be construed as limiting the systems, methods, and apparatuses of the present disclosure.

Figure 1:
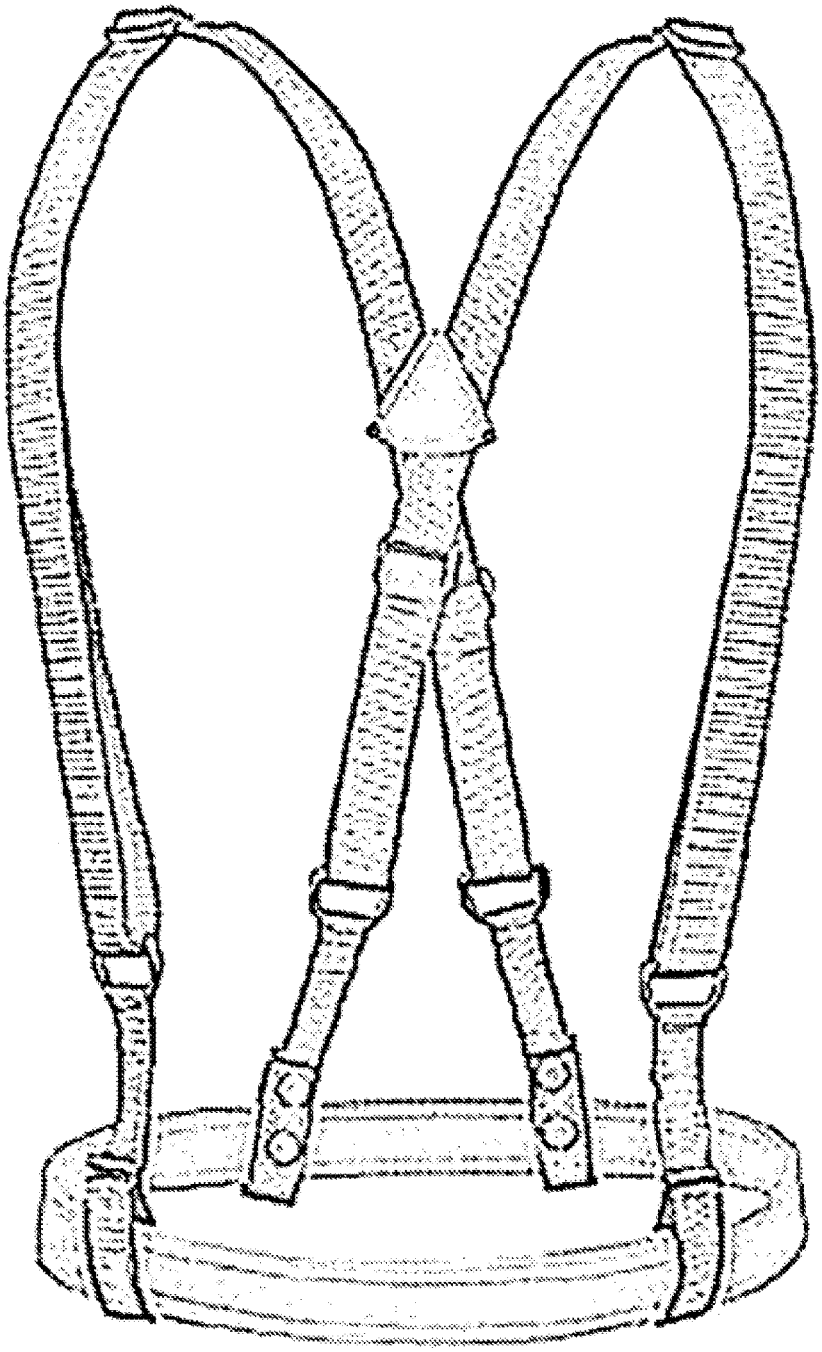
PRIOR ART FIG. 1
FIG. 1 shows a prior art suspender system.

Turning now to the drawing Figs., FIG. 1 shows a prior art suspender system. Suspenders designed to be worn outside the wearer's shirt have been offered in the past.

Unfortunately, exposed suspenders often times have a sloppy or non-conventional appearance. Exposed suspenders are also troubled by the possibility of their catching on things and thereby entangling the wearer.

For military or law enforcement personnel, exposed suspenders have an inherent risk that an attacker could use the exposed suspenders straps as a means by which to grab and manhandle the wearer during an altercation.

In response to some of these concerns, some of these exposed suspenders were designed to attach to a duty/tool belt with breakaway keepers that unsnapped when a certain amount of force is applied to the keepers. Unfortunately, this can result in the keepers regularly unsnapping during routine use.

In order to overcome these and other disadvantages of known suspender systems, the present disclosure, as illustrated in FIGS. 2-34C, provides a load bearing and/or suspension system that is at least partially concealed under a wearer's shirt.

FIGS. 2A-2K show various views of the components of a first exemplary embodiment of the load bearing and/or suspension system according to the present disclosure. As illustrated in FIGS. 2A-2K, the load bearing and/or suspension system 100 includes at least some of a belt 110, a harness 130, an undergarment 150, and a shirt 170.

In various exemplary embodiments, the belt 110 is substantially rigid. The belt 110 includes a belt padding element 116 that extends around a lower portion of the belt, at least along a portion of the belt 110 that will be located over a wearer's hips. In various exemplary embodiments, the belt padding element 116 includes a rolled, molded edge of the belt. The belt padding element 116, if included, provides a degree of padding to provide a measure of comfort to the wearer.

The belt 110 also includes belt attachment element 112 that generally extend from or are embedded within the belt 110.

The harness 130 comprises a fabric, webbing, mesh, or reinforced fiber material that is flexible enough to drape over the shoulders of the wearer, and strong enough to support at least a portion of a load while in tension. Each end of the harness 130 terminates in a harness attachment means 132.

The belt attachment element 112 and the harness attachment means 132 include corresponding mating attachment means, such as, for example, amish buttons, male/female snap-release buckles, Velcro or other hook-and-loop fasteners, a corresponding button and buttonhole, mating snaps, hook-and-eye closures, or other fastening means for removably interlacing or attaching the belt attachment element 112 to the harness attachment means 132.

The undergarment 150 may comprise an undershirt, T-shirt, or vest. In various exemplary embodiments, the undergarment 150 may have certain ballistic properties. As illustrated, undergarment 150 is intended to be worn under the harness 130.

The overgarment or shirt 170 is intended to be worn over a predominant portion of the harness 130, but tucked under or into the belt 110 so as to at least partially conceal or hide the harness 130 under the shirt 170. In order for the harness attachment means 132 to be able to engage the belt attachment element 112, one or more apertures 172 are formed through the shirt 170. In various exemplary embodiments, the aperture's 172 are formed proximate the location of the belt attachment element 112. It should be appreciated that the closer the location of the apertures 172 to the belt attachment element 112, the less of the harness 130 that becomes visible outside of the shirt 170.

In various exemplary embodiments, the apertures 172 include grommets, stitching, or other reinforcement around their perimeter.

By incorporating apertures 172 in the shirt 170, when the load bearing and/or suspension system 100 is worn, the belt 110 can be worn in a traditional fashion, over the wearer's pants and shirt 170, while the harness 130 can be worn under the shirt 170. The harness attachment means 132 are able to pass through the apertures 172 in order to connect or attach to the belt attachment element 112.

Thus, the harness 130 is able to be releasably connected or coupled to the belt 110 such that the load of the belt 110 can be shared between the belt 110 and the harness 130, and thus be distributed between the wearer's hips and shoulders.

Figure 2A:
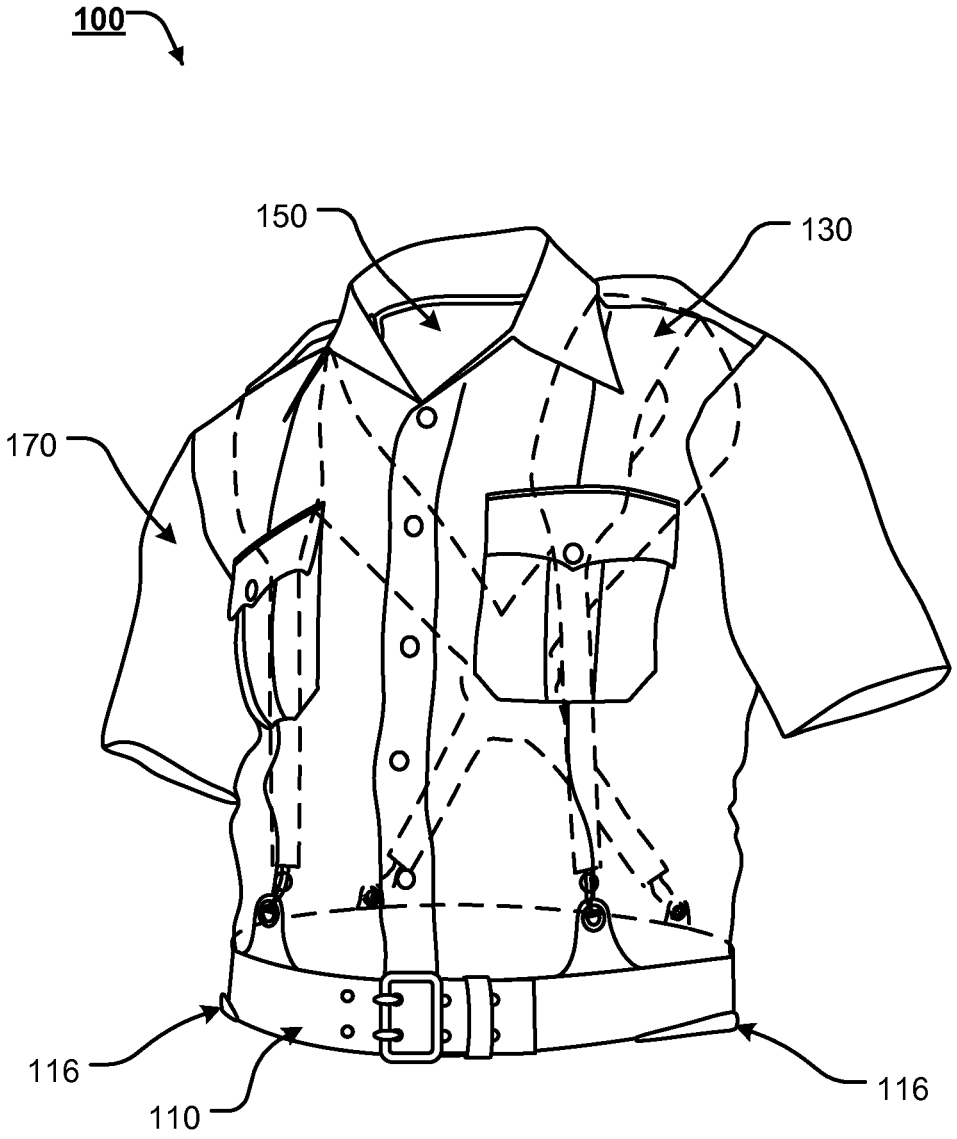
FIGS. 2A-2K show various views of the components of a first exemplary embodiment of a load bearing and/or suspension system according to the present disclosure.
Figure 2B:
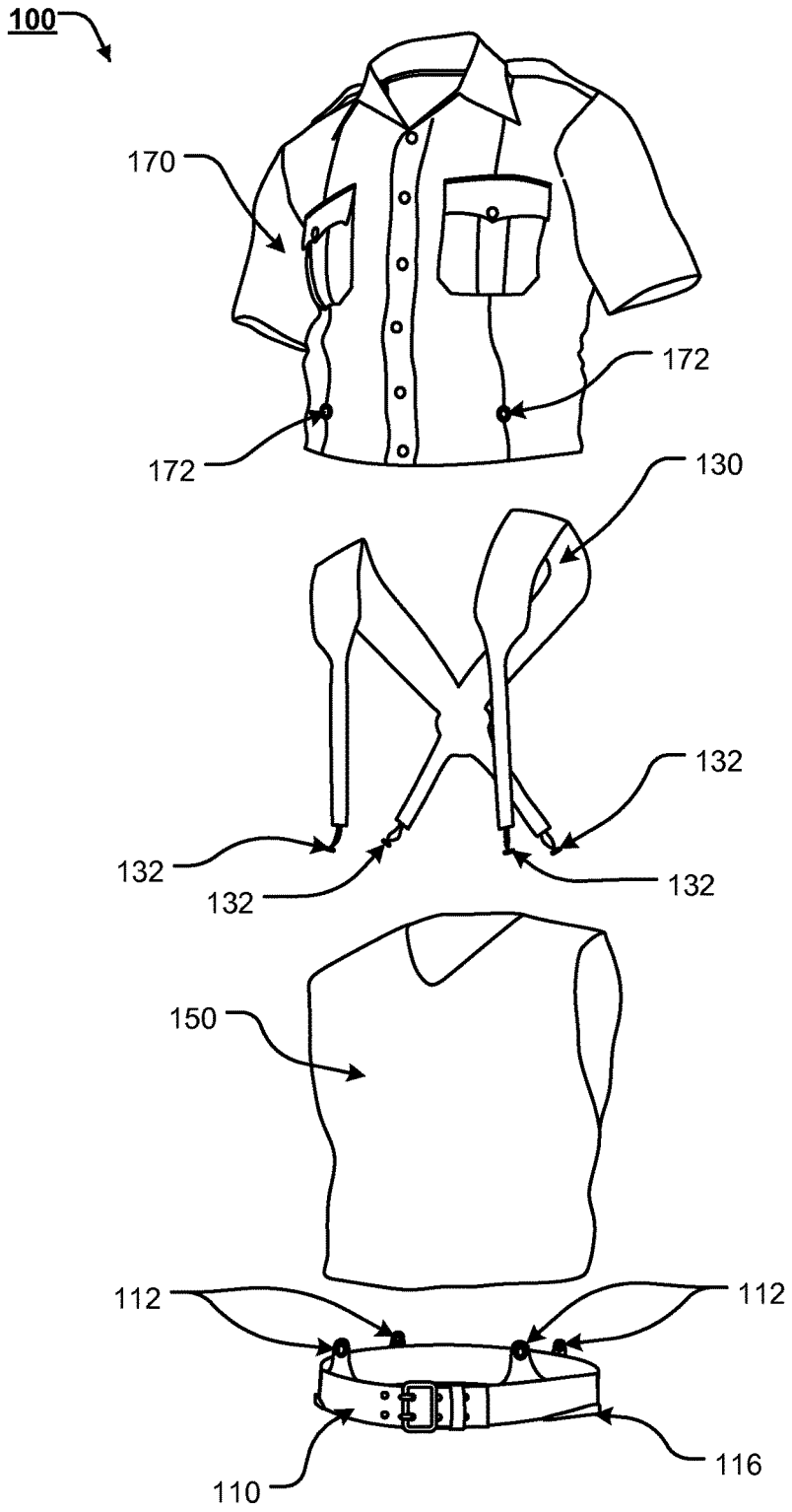
Figure 2C:
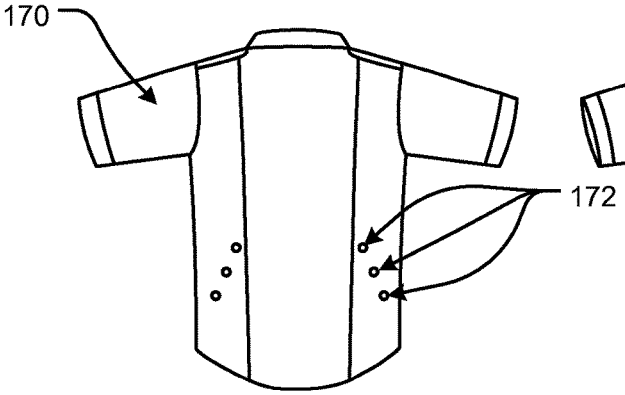
Figure 2D:
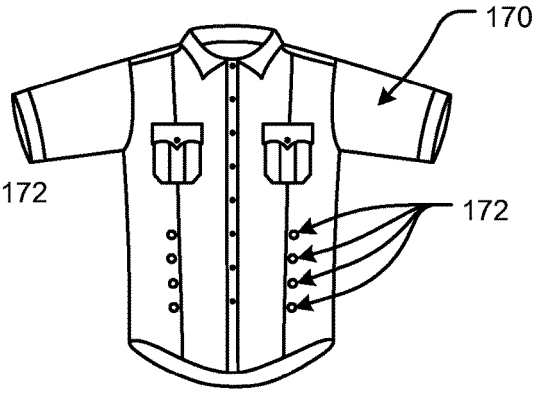
Figure 2E:
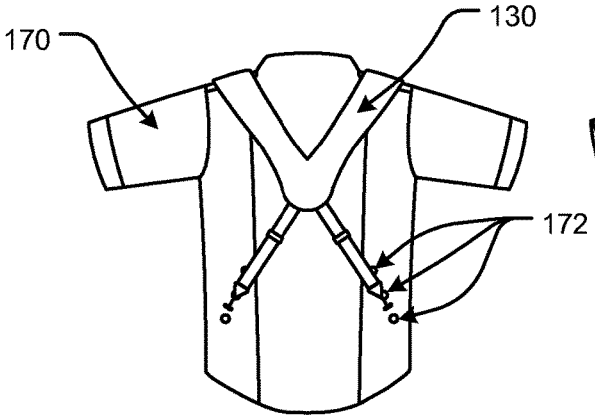
Figure 2F:
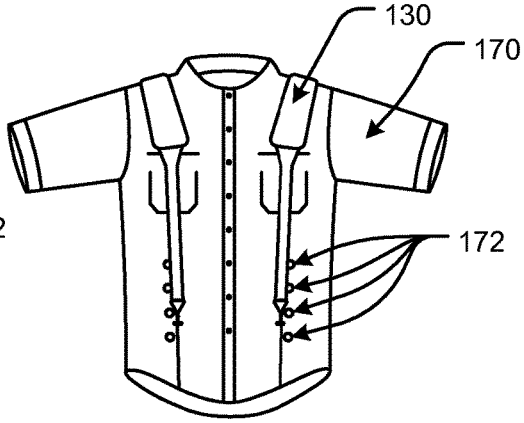
Figure 2G:
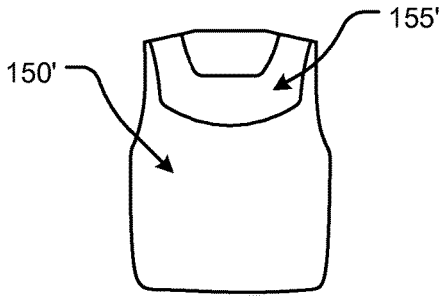
Figure 2H:
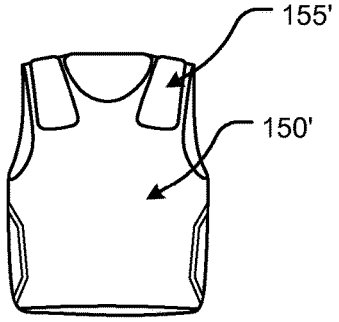
Figure 2I:
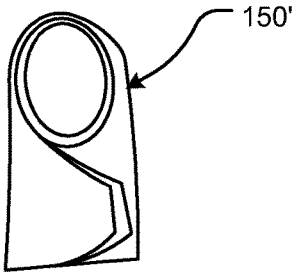
Figure 2J:
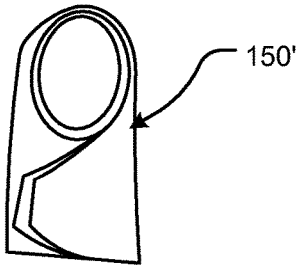
Figure 2K:
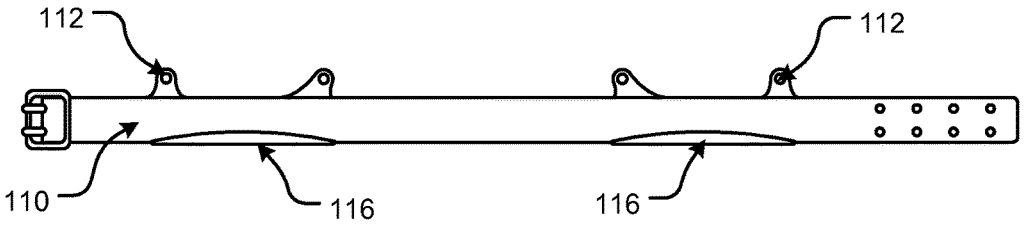

It should be appreciated that FIGS. 2C and 2D show exterior views of the shirt 170, while FIGS. 2E and 2F show interior views of the shirt 170 so as to illustrate relative positioning of the harness 130 within the shirt 170.

As illustrated in FIGS. 2C and 2D, the shirt 170 may include multiple apertures 172 at different positions, accommodating users having different torso heights.

In various exemplary embodiments, as illustrated in FIGS. 2G-2J, the undergarment 150 may comprise an undergarment 150', which includes additional padding 155' proximate and area where the harness 130 will transmit a load to the wearer's shoulders. Additionally, the undergarment 150' may include Velcro or other hook and loop closure means that provide girth adjustments and make it easier for a wearer to put the undergarment 150' on or take the undergarment 150' off.

It should be appreciated that a shirt or other overgarment may be retrofitted to accommodate the harness 130. For example, an existing shirt may be modified to include apertures similar to the apertures 172. Thus, a wearer may take a current shirt and make a simply alteration to employ the load bearing and/or suspension system 100.

FIGS. 3A-3K show various views of the components of an exemplary embodiment of the load bearing and/or suspension system according to the present disclosure, wherein the harness 130, as illustrated in FIGS. 2A and 2B, is replaced by a vest or overgarment 230.

As illustrated in FIGS. 3A-3K, the load bearing and/or suspension system 200 includes at least some of a belt 210 having a belt padding element 216, an undergarment 250, and a shirt 270. It should be appreciated that the belt 210 and the undergarment 250 correspond to and operate similarly to the belt 110, the belt padding elements 116, and the undergarment 150, as described above, with reference to FIGS. 2A-2K.

However, the vest 230 is designed to be worn over the shirt 270 and provide load-bearing support to the belt 210. The vest 230 includes belt loops 233, which provide a means for removably securing the belt 210 to the vest 230.

Figure 3A:
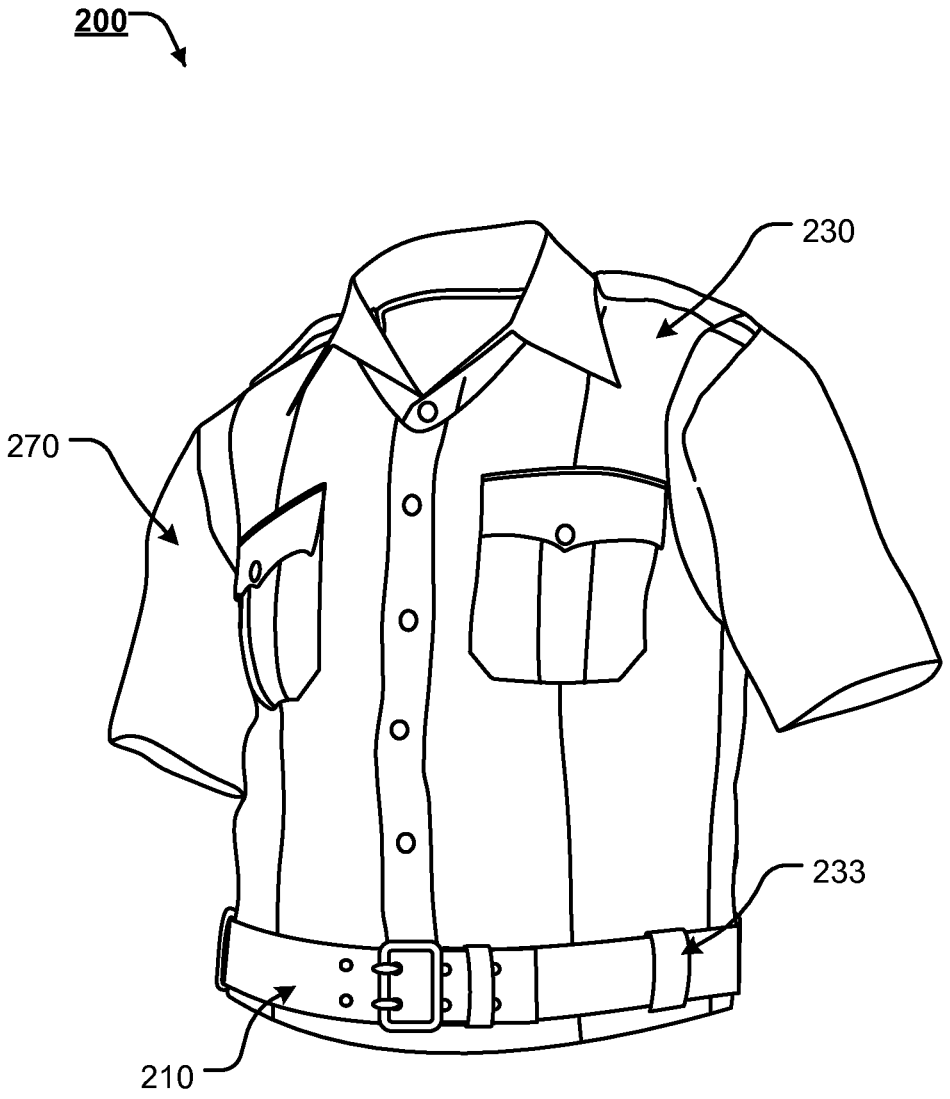
FIGS. 3A-3K show various views of the components of an exemplary embodiment of the load bearing and/or suspension system according to the present disclosure.
Figure 3B:
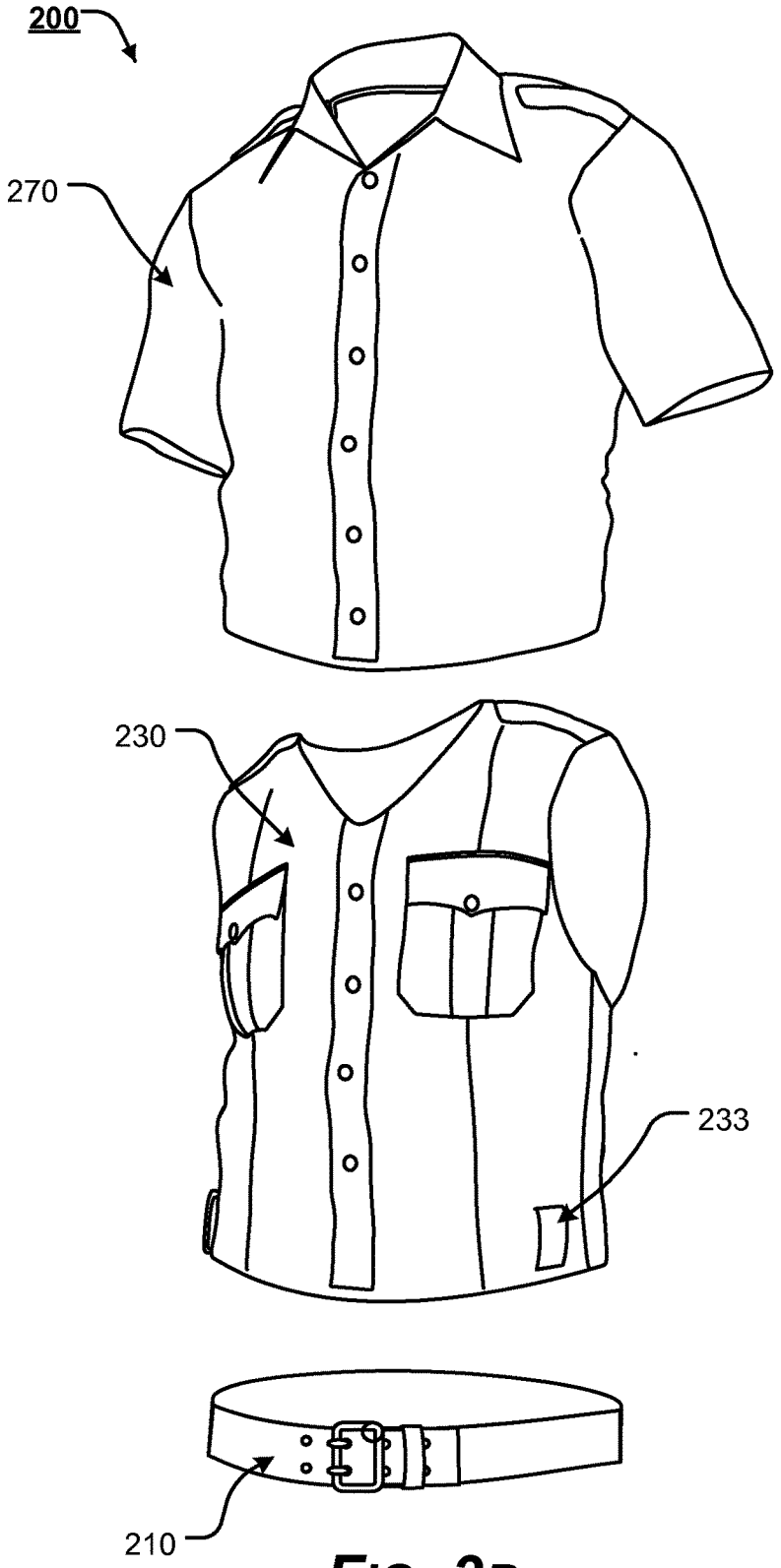
Figure 3C:
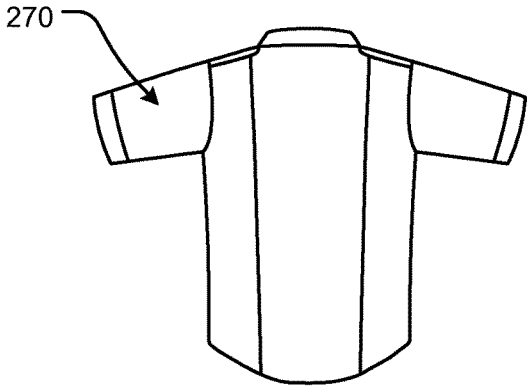
Figure 3D:
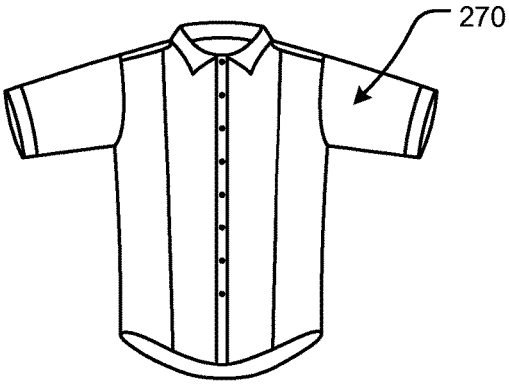
Figure 3E:
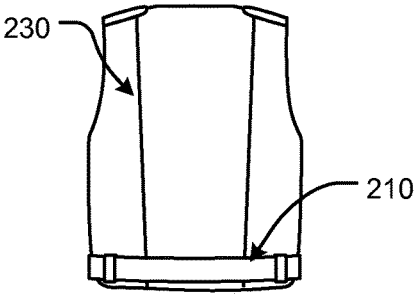
Figure 3F:
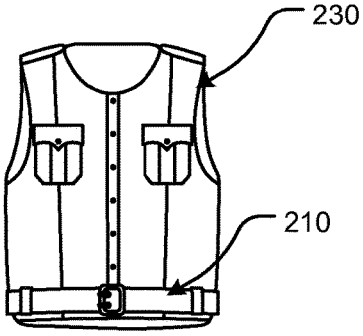
Figure 3G:
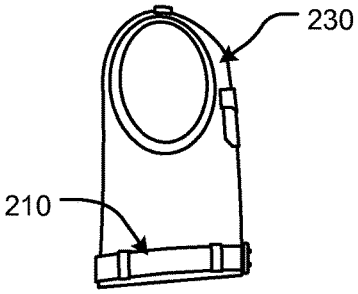
Figure 3H:
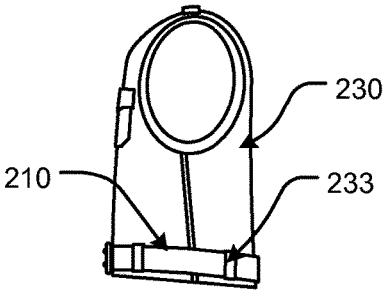
Figure 3I:
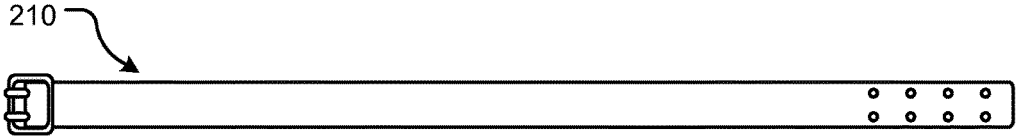
Figure 3J:
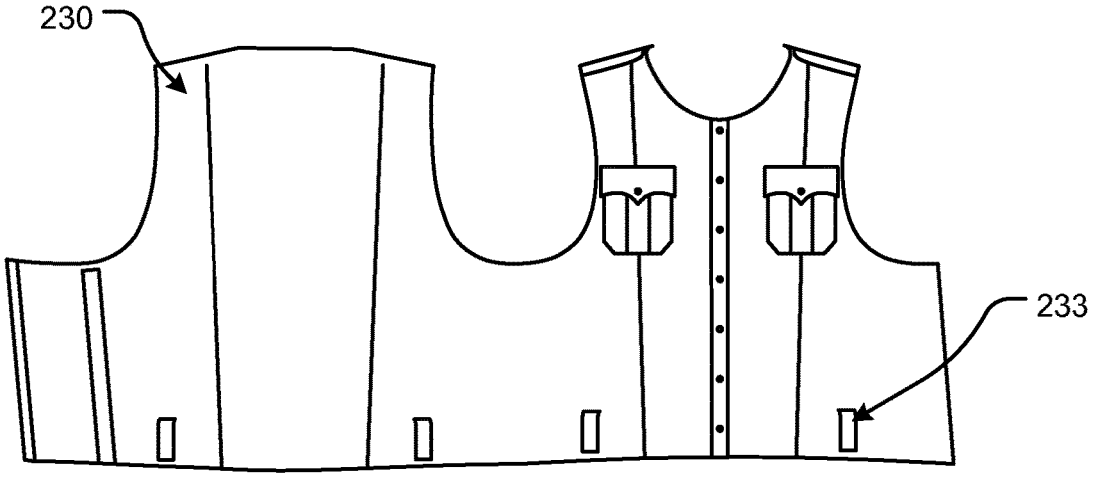
Figure 3K:
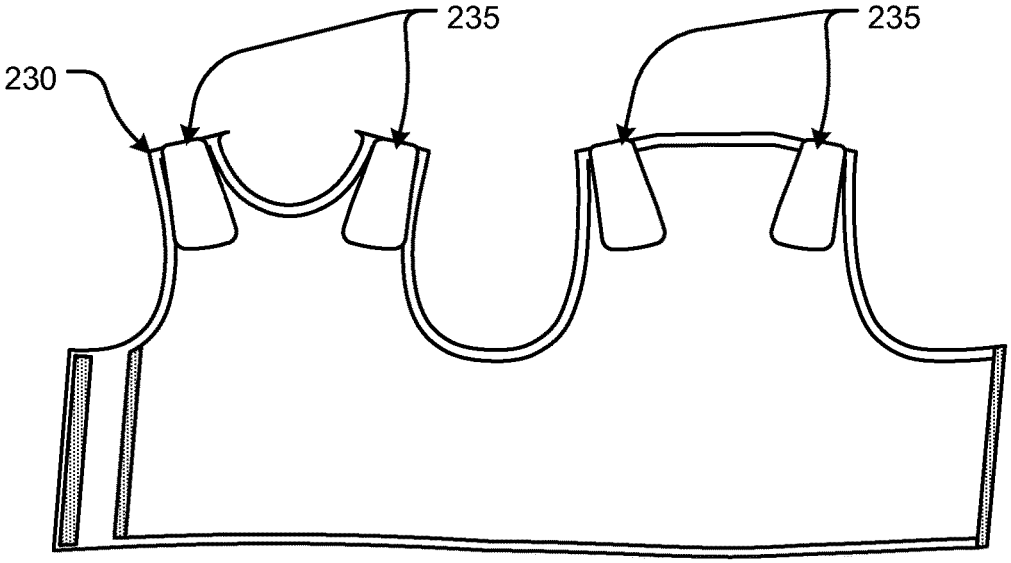

As illustrated in FIGS. 3J and 3K, the vest 230 may optionally include padding elements 235 and may optionally include Velcro or other hook and loop closure means that provide girth adjustments and make it easier for a wearer to put the vest 230 on or take the vest 230 off.

FIGS. 4A-4K, 10A-10C, and 12A-12E show various views of the components of an exemplary embodiment of the load bearing and/or suspension system according to the present disclosure. As illustrated in FIGS. 4A-4K, 10A-10C, and 12A-12E, the load bearing and/or suspension system 300 includes at least some of a belt 310 having a belt padding element 316, an undergarment 350, and a shirt 370. However, the apertures 172 of the shirt 170, as illustrated in FIGS. 2A and 2B, are repositioned from a position in the front and rear of the shirt to a positioned proximate the sides of the shirt 370. Additionally, the apertures 372 of the shirt 370 are somewhat larger than the apertures 172 of the shirt 170. Likewise, corresponding belt attachment element 312 are located in an area of the belt 310 that will be positioned proximate sides of the wearer when the load bearing and/or suspension system 300 is worn.

In various exemplary embodiments, the harness 330 includes an adjustment dial 335 that allows the length of the harness attachment means 332 to be adjusted. In various exemplary embodiments, when the adjustment dial 335 is rotated or otherwise manipulated, a portion of cable or webbing 333 is adjusted so that the length of the harness attachment means 332 is altered.

In various exemplary, non-limiting embodiments, an adjustment dial 335 is positioned within the load bearing and/or suspension system in order to allow the system to be adjusted for each individual wearer. While an adjustment dial 335 may be utilized, any device capable of retracting appropriate section(s) of the load bearing and/or suspension system may be utilized.

The adjustment dial 335 may be manually manipulated to extend or retract portions of the load bearing and/or suspension system 300. Alternatively, the adjustment dial 335 may allow for auto-retraction and/or tensioning of the components of the harness 330.

In various exemplary, non-limiting embodiments, the adjustment dial 335, or other retracting device, is attached or coupled to the harness 330. Alternatively, an adjustment dial, or other retracting device, may be attached to or imbedded within a portion of the belt, as illustrated in FIGS. 18A-26C.

Figure 4A:
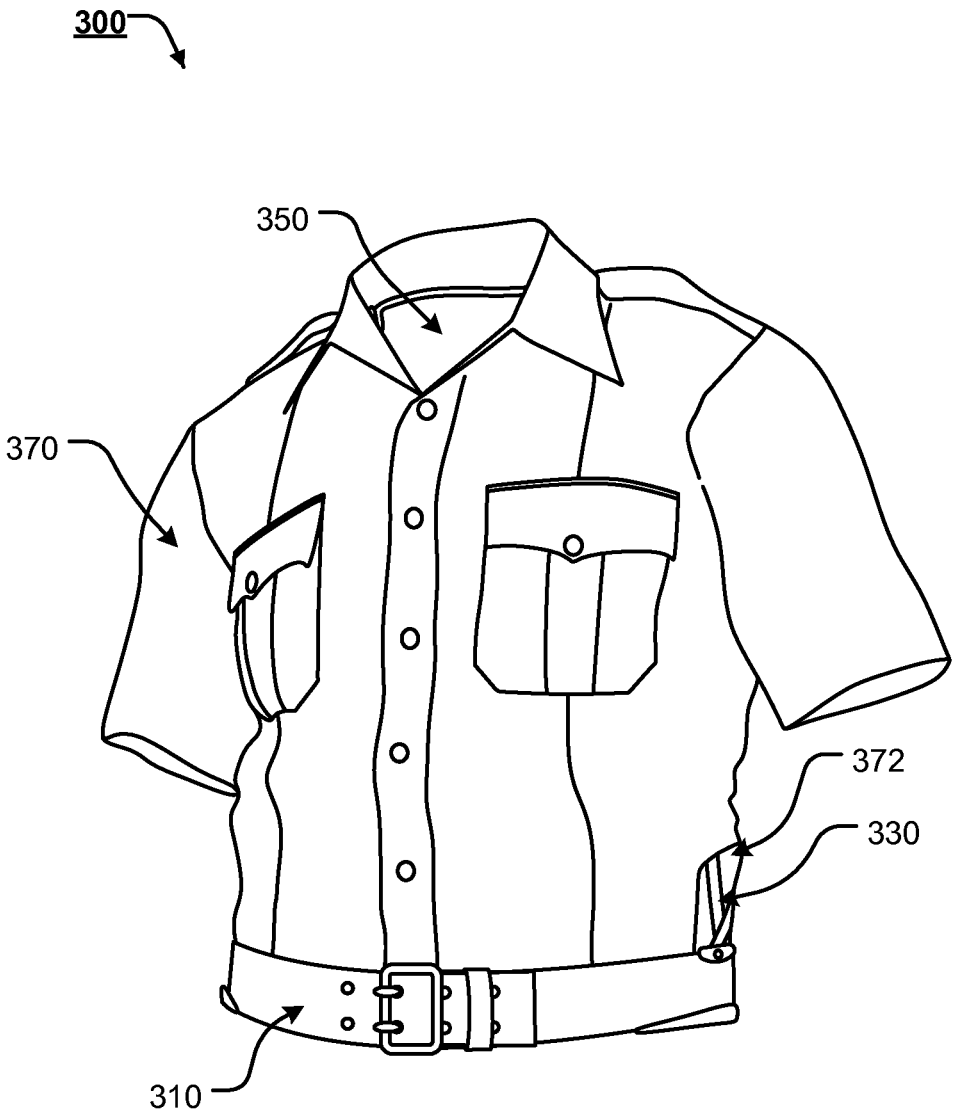
FIGS. 4A-4K show various views of the components of an exemplary embodiment of the load bearing and/or suspension system according to the present disclosure.
Figure 4B:
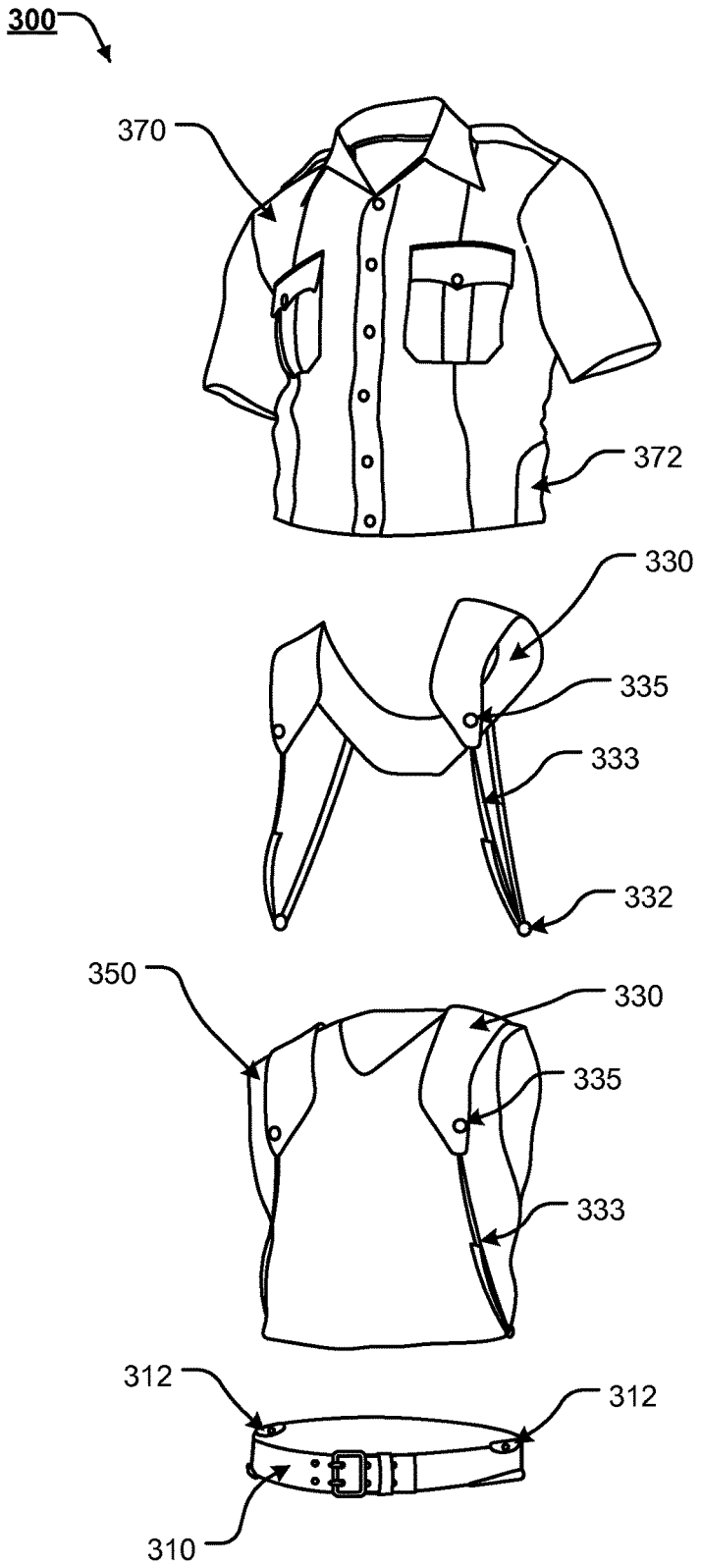
Figure 4C:
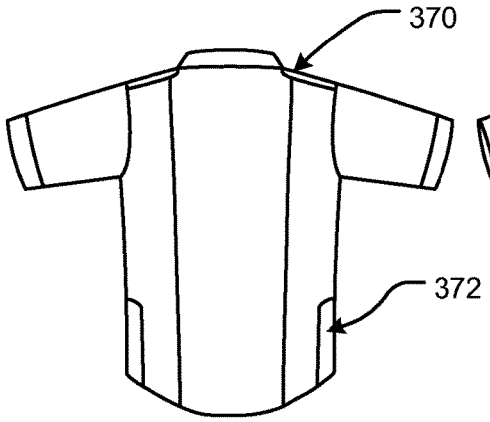
Figure 4D:
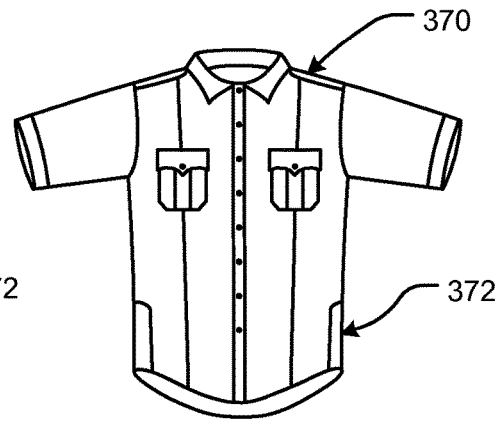
Figure 4E:
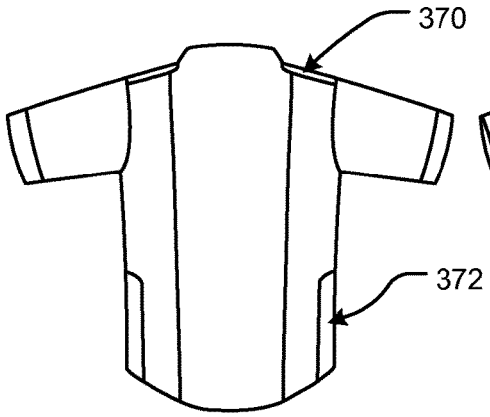
Figure 4F:
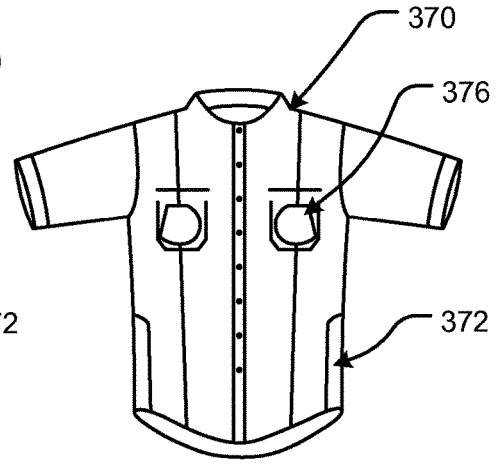

As further illustrated in FIGS. 4B and 4F, which show interior views of the shirt 370, the shirt 370 may include adjustment dial access apertures 376 form behind the front pockets of the shirt 370. Included, the adjustment dial access apertures of 376 provide access to the adjustment dials 335, such that the length of the harness attachment means 332 can be adjusted while the load bearing and/or suspension system 300 is worn.

Figure 11A:
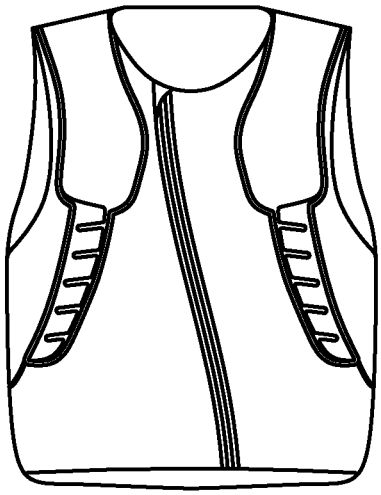
FIGS. 11A-11C show various views of an exemplary embodiment of a vest and harness to be utilized in conjunction with the load bearing and/or suspension system according to the present disclosure.
Figure 11B:
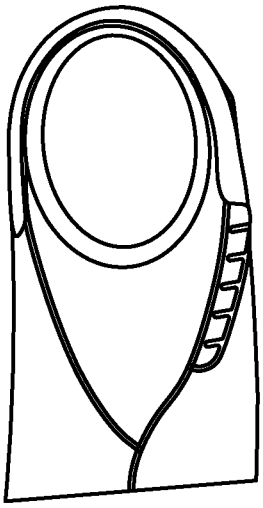
Figure 11C:
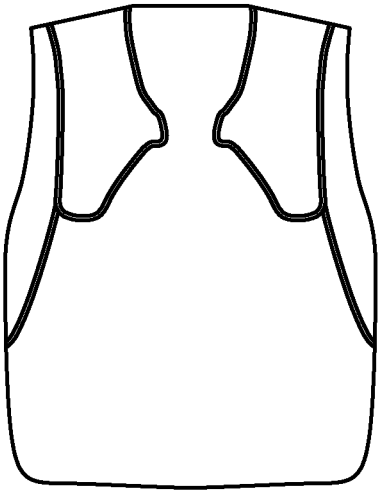
Figure 12A:
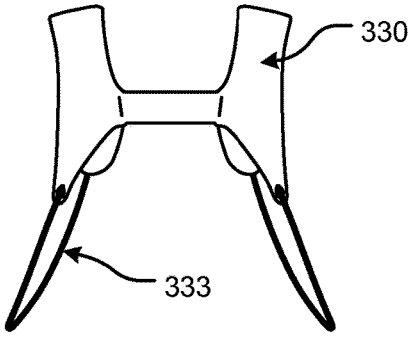
FIGS. 12A-12E show various views of an exemplary embodiment of a harness to be utilized in conjunction with the load bearing and/or suspension system according to the present disclosure.
Figure 12B:
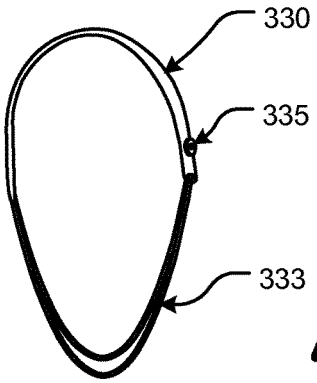
Figure 12C:
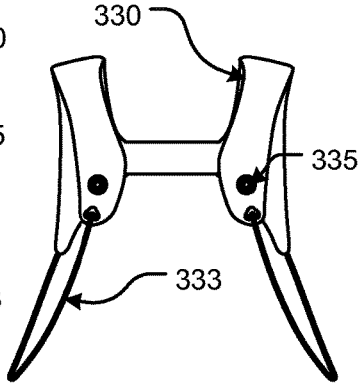
Figure 12D:
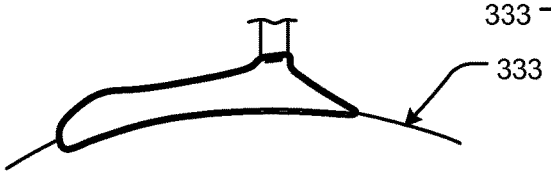
Figure 12E:
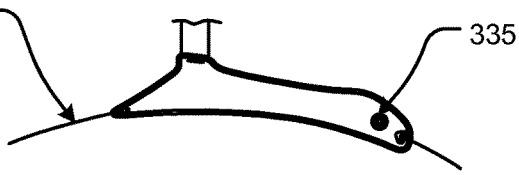

It should be appreciated that the adjustment dial 335 is optional and at the harness 330 may be utilized without the adjustment dial 335, as illustrated in FIGS. 11A-11C.

Figure 4G:
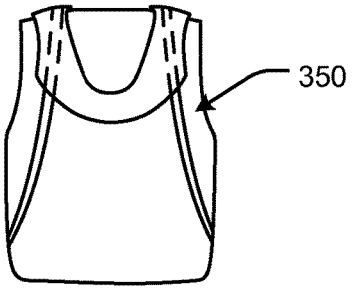
Figure 4H:
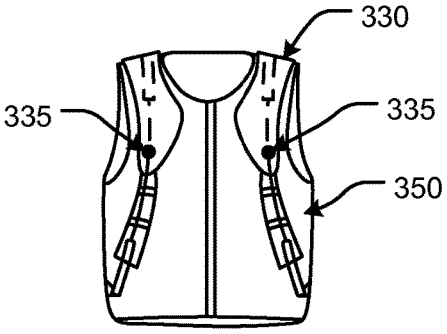
Figure 4I:
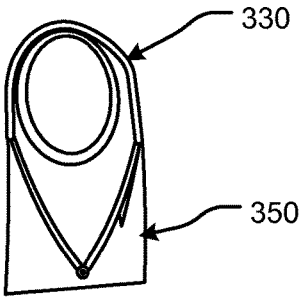
Figure 4J:
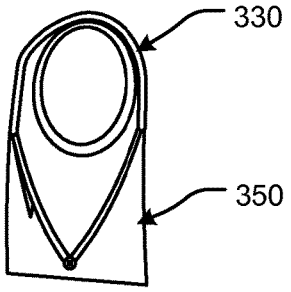
Figure 4K:
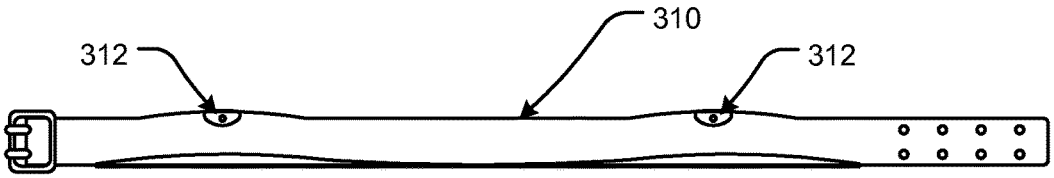

As illustrated, for example, in FIG. 4G, the undergarment 350 may optionally include padding elements 335 and may optionally include Velcro or other hook and loop closure means that provide girth adjustments and make it easier for a wearer to put the undergarment 350 on or take the undergarment 350 off.

In various exemplary embodiments, the load bearing and/or suspension system 300 includes a padded harness 330 passing over each of the wearer's shoulders, similar in design to a handgun shoulder holster harness. A nylon strap with Velcro adjustment, or a circular plastic "X" juncture, connects the two shoulder sections behind the wearer's neck, between the shoulder blades. Each shoulder section passes over the front and rear of the shoulder, and joins below the wearer's armpit, where the front and rear straps connect to a nylon pad.

The nylon pad holds a knob-shaped dial-type, adjustment dial 335, by means of which the user can lengthen or shorten a loop of vinyl covered steel wire 333 by turning the adjustment dial 335. Attached to the bottom end of the dial-adjustable portion of cable 333, on the wearer's right and left sides, are harness attachment means 332 that attach to belt attachment element 312. The harness attachment means 332 on each side passes through the aperture 372 in the shirt 370, to allow the harness attachment means 332 to attached to the belt attachment element 312 and provide support to the belt 310 at a point approximately even with the side-seam of the wearer's uniform trousers.

Figure 5A:
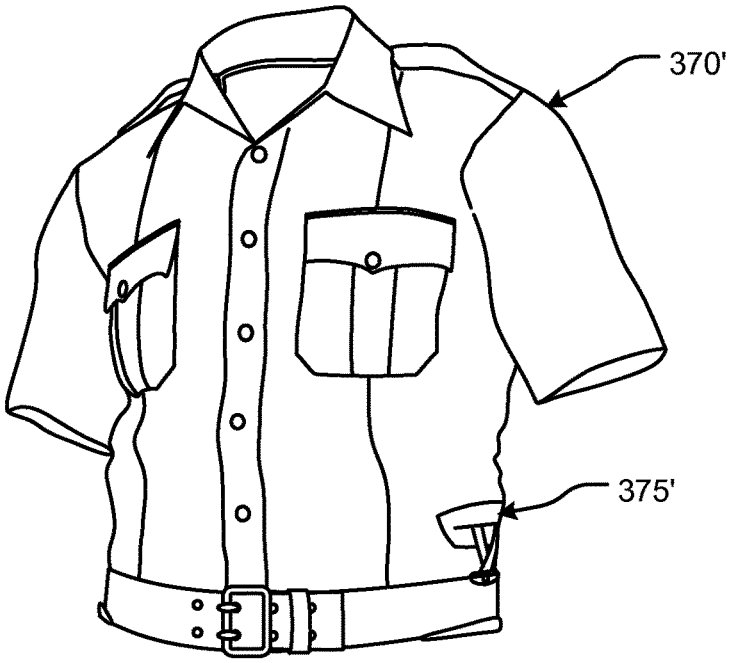
FIGS. 5A-5C show various components of an exemplary embodiment of the load bearing and/or suspension system according to the present disclosure.
Figure 5B:
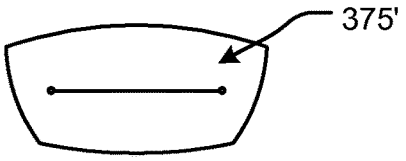
Figure 5C:
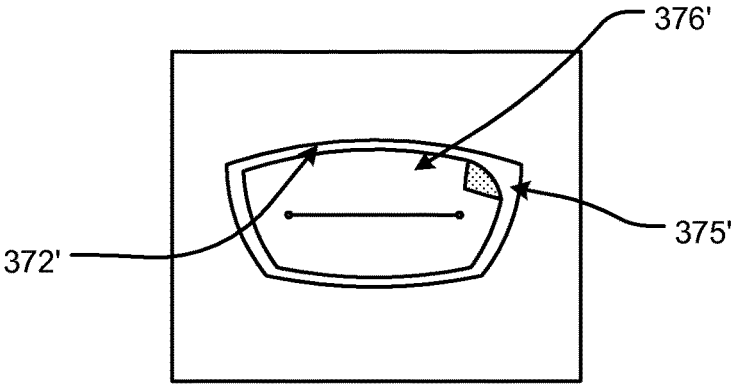

FIGS. 5A-5C show various components of an exemplary embodiment of the load bearing and/or suspension system according to the present disclosure.

As illustrated in FIGS. 5A-5C, an enlarged slot 376' may be formed in the shirt 370' to act as an aperture 372'. In various exemplary embodiments, a portion of reinforcing material 375' maybe attached or coupled to the shirt 370' to reinforce the aperture 372'.

In certain exemplary embodiments, at least a portion of the reinforcing material 375' may include a flap-style closure that can be secured, for example, by Velcro.

Use of the reinforcing material 375' may also be used if an existing shirt is modified to be used with the load bearing and/or suspension system according to the present disclosure.

Figure 6A:
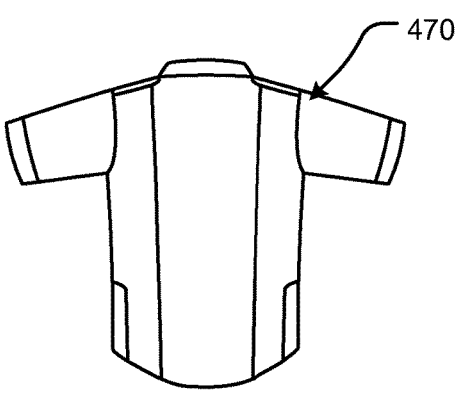
FIGS. 6A-6C show various views of an exemplary embodiment of a shirt to be utilized in conjunction with the load bearing and/or suspension system according to the present disclosure.
Figure 6B:
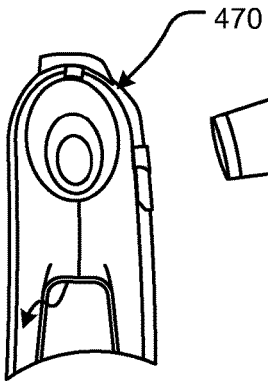
Figure 6C:
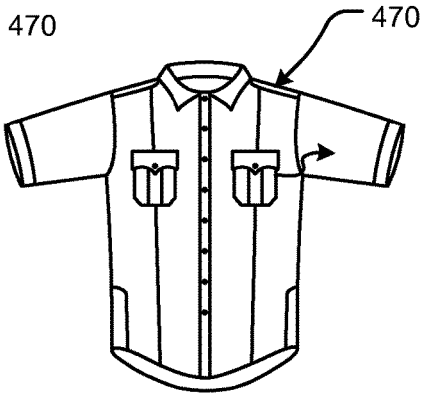

FIGS. 6A-7C show a rear view, a side view, and a front view, respectively, of an exemplary embodiment of a shirt 470 that can be utilized in conjunction with the load bearing and/or suspension system according to the present disclosure. More specifically, FIGS. 6A-6C show an exterior view of alternate embodiment of a shirt 470 having an aperture 472, which includes a flap-style closure that can be opened so that elements of the load bearing and/or suspension system can be adjusted while the system is being worn.

Figure 7A:
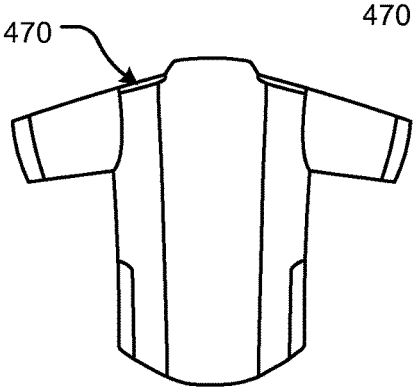
FIGS. 7A-7C show various views of an exemplary embodiment of a shirt to be utilized in conjunction with the load bearing and/or suspension system according to the present disclosure.
Figure 7B:
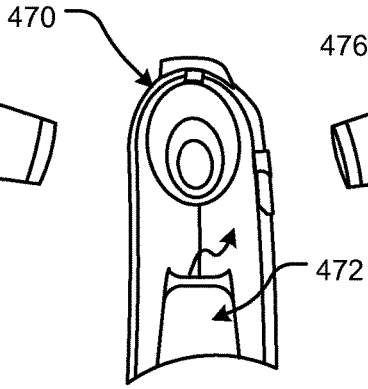
Figure 7C:
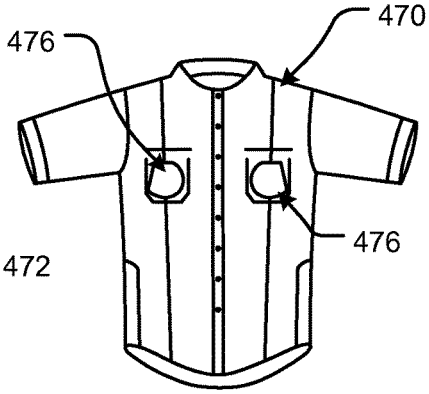

FIGS. 7A-7C show and interior view of the shirt 470, illustrating the aperture 472 and further illustrating adjustable dial access apertures 476 positioned below the front pockets of the shirt 470.

Figure 8A:
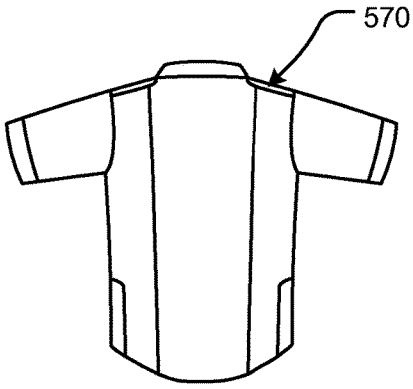
FIGS. 8A-8C show various views of an exemplary embodiment of a shirt to be utilized in conjunction with the load bearing and/or suspension system according to the present disclosure.
Figure 8B:
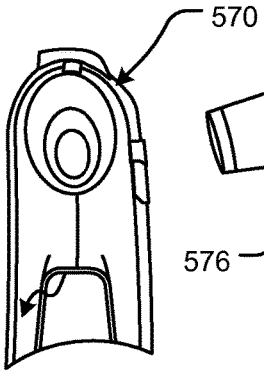
Figure 8C:
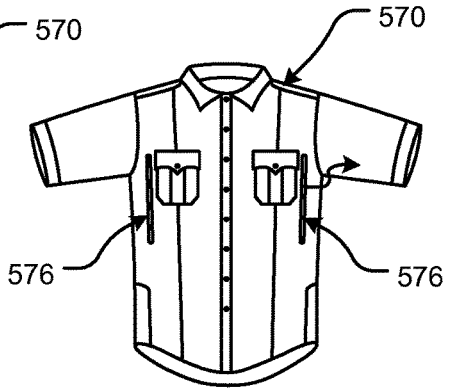
Figure 9A:
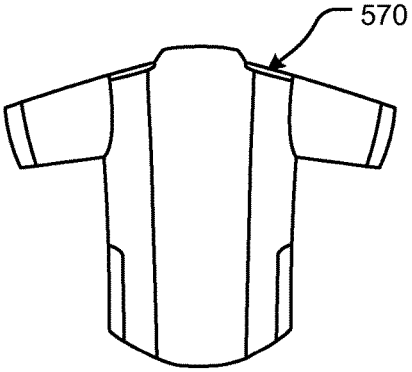
FIGS. 9A-9C show various views of an exemplary embodiment of a shirt to be utilized in conjunction with the load bearing and/or suspension system according to the present disclosure.
Figure 9B:
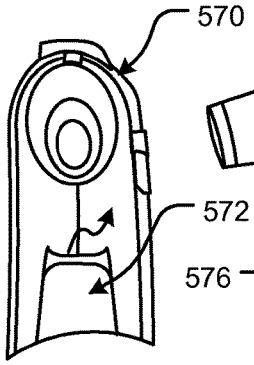
Figure 9C:
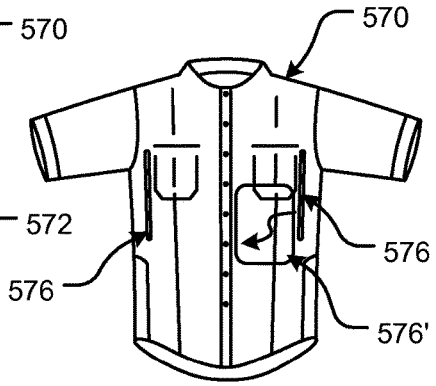
Figure 10A:
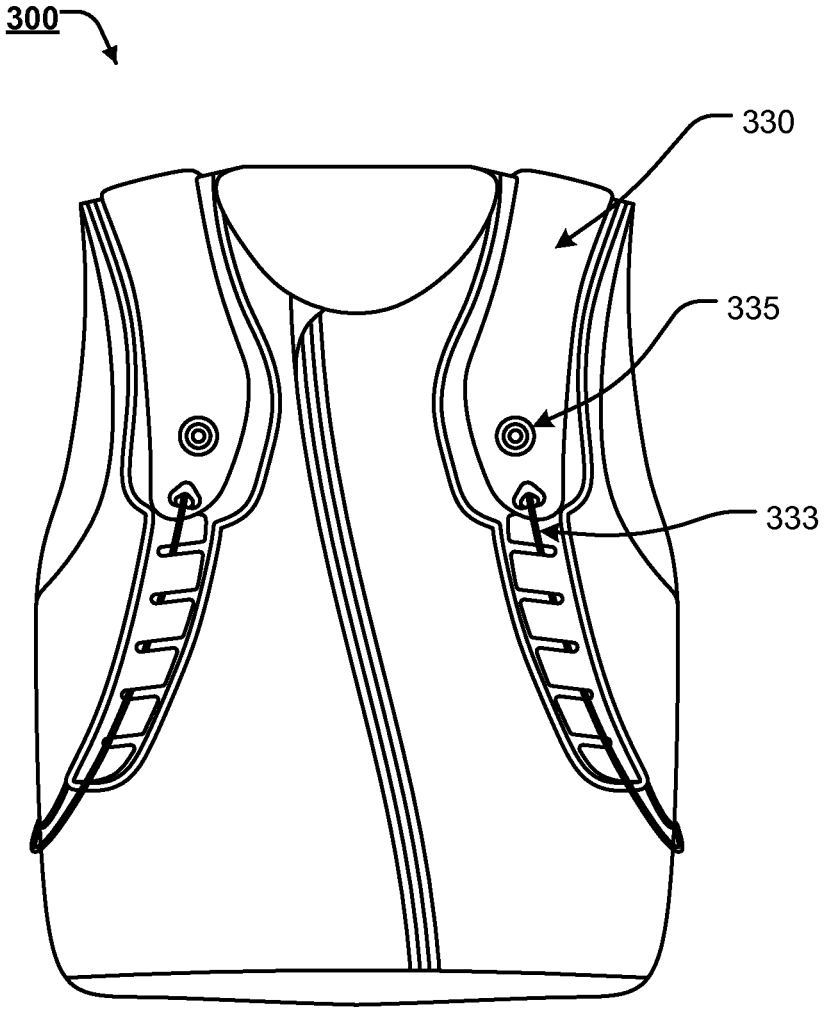
FIGS. 10A-10C show various views of an exemplary embodiment of a vest and harness to be utilized in conjunction with the load bearing and/or suspension system according to the present disclosure.
Figure 10B:
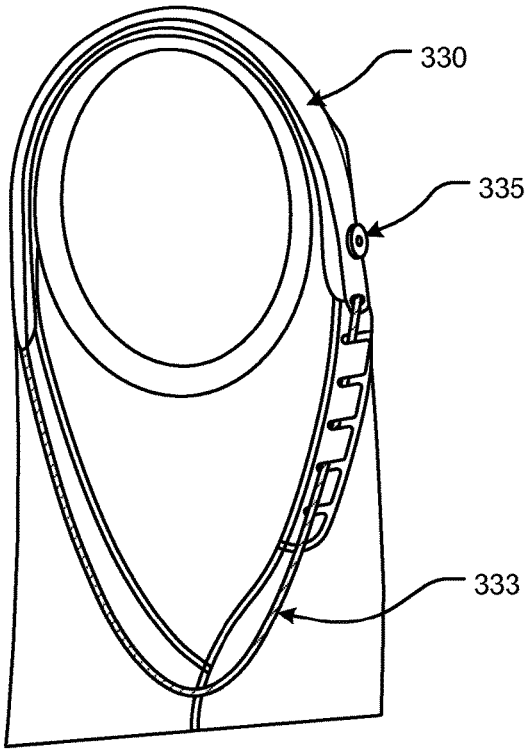
Figure 10C:
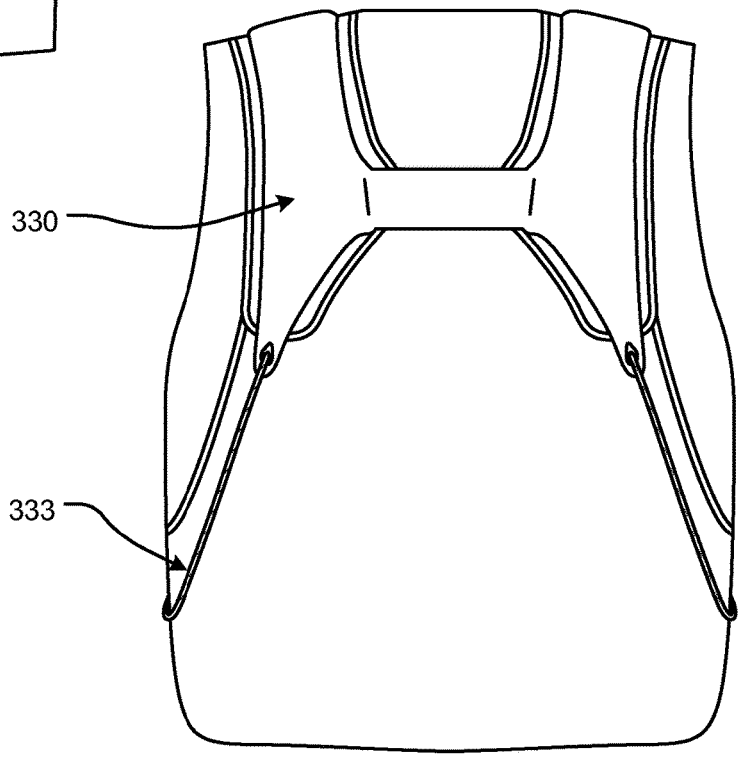

FIGS. 8A-9C show a rear view, a side view, and a front view, respectively, of an exemplary embodiment of a shirt 570 that can be utilized in conjunction with the load bearing and/or suspension system according to the present disclosure. More specifically, FIGS. 8A-8C show an exterior view of alternate embodiment of a shirt 570 having an aperture 572, which includes a flap-style closure that can be opened so that elements of the load bearing and/or suspension system can be adjusted while the system is being worn. FIGS. 9A-9C show and interior view of the shirt 570, illustrating the aperture 572.

As further illustrated in FIGS. 8A-9C, the shirt 570 also includes adjustable dial access apertures 576 positioned proximate the front pockets of the shirt 570. The adjustable dial access apertures 576 incorporate longer zipper or Velcro closure access to reach in for adjusting the adjustment dial 335. In certain exemplary, non-limiting embodiments, the shirt or other overgarment may include a substantially flat interior pocket 576' in this opening where a wearer can keep important personal items, such as, for example, identification cards.

Figure 13A:
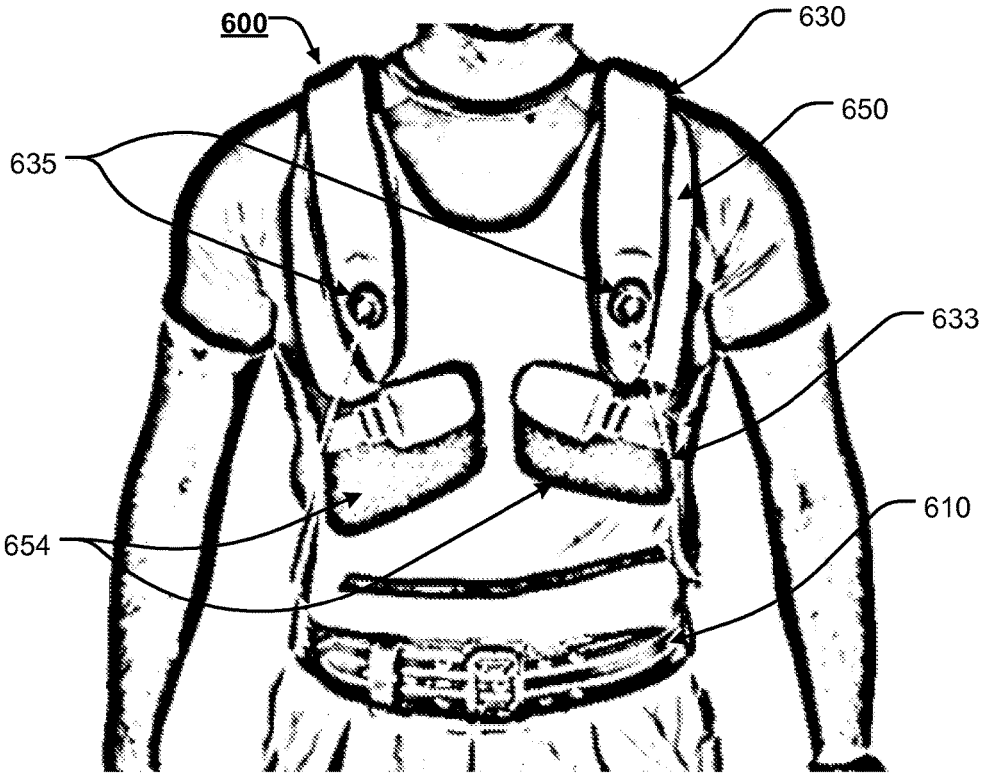
FIGS. 13A-13C show various views of an exemplary embodiment of a vest, harness, and belt to be utilized in conjunction with the load bearing and/or suspension system according to the present disclosure.
Figure 13B:
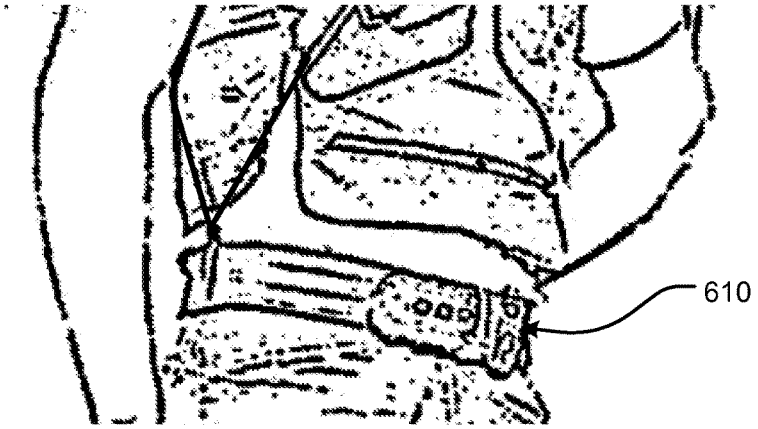
Figure 13C:
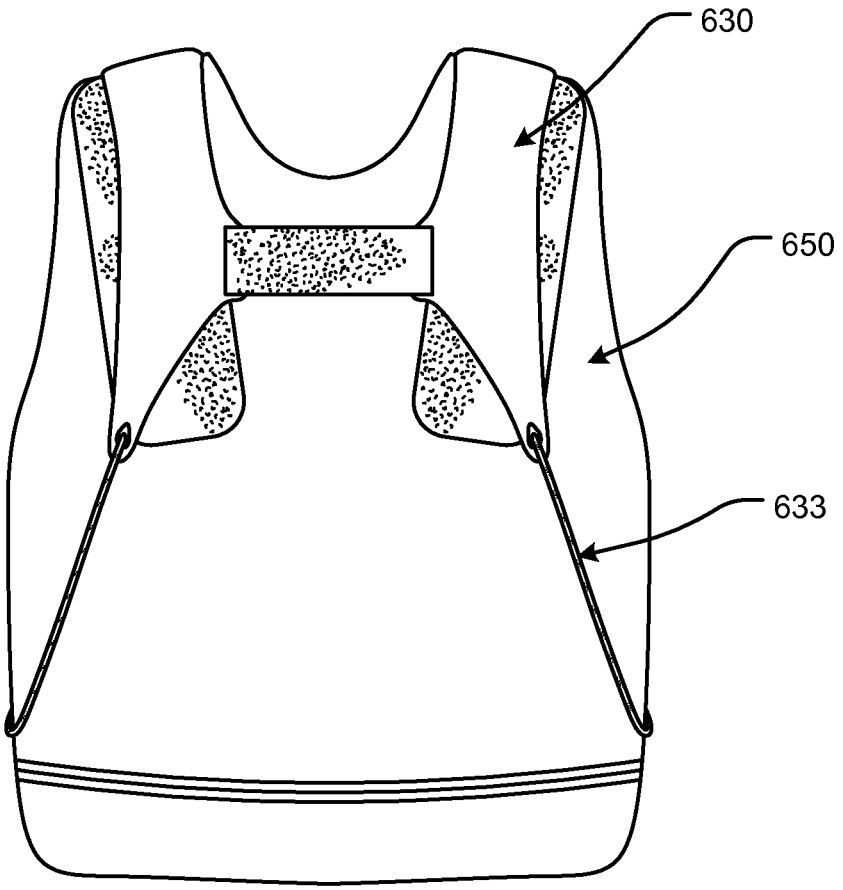

FIGS. 13A-13C show various views of an exemplary embodiment of a vest, harness, and belt to be utilized in conjunction with the load bearing and/or suspension system according to the present disclosure. As shown in FIGS. 13A-13C, the load bearing and/or suspension system 600 is similar to the load bearing and/or suspension system 300, including a belt 610, a harness 630, and undergarment 650, adjustment dials 635, cable 633, and Velcro closure means 654. However, the harness 630 of the load bearing and/or suspension system 600 is releasably attached, via Velcro, to the undergarment 650.

Figure 14A:
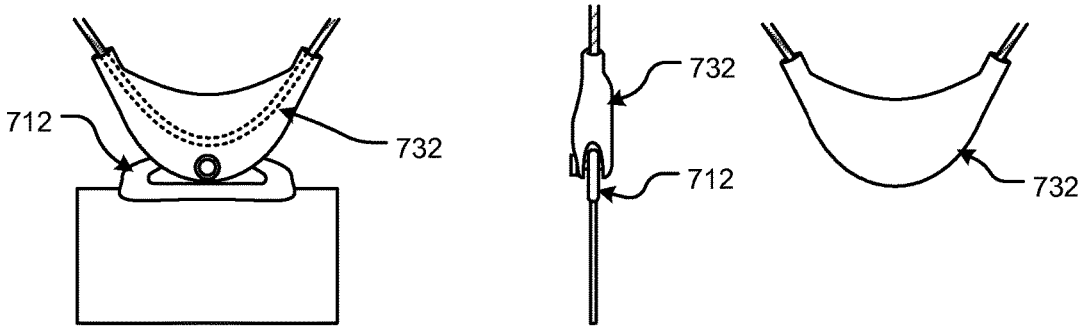
FIGS. 14A-14C show various views of exemplary attachment means to be utilized in conjunction with the load bearing and/or suspension system according to the present disclosure.
Figure 14B:
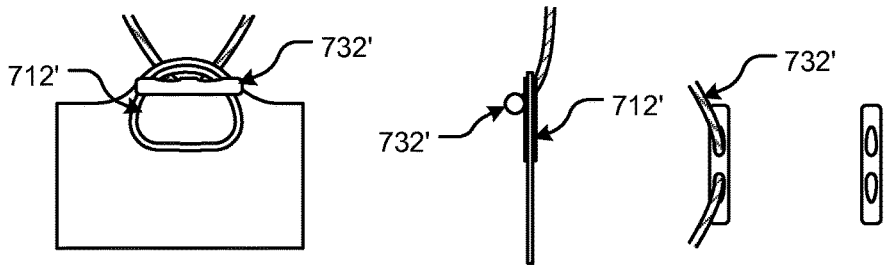
Figure 14C:
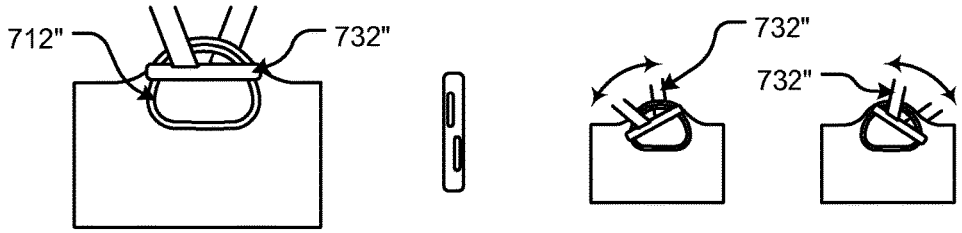

FIGS. 14A-14C show various views of exemplary belt attachment element 712, 712', and 712" and harness attachment means 732, 732', and 732" to be utilized in conjunction with the load bearing and/or suspension system according to the present disclosure.

Figure 15:
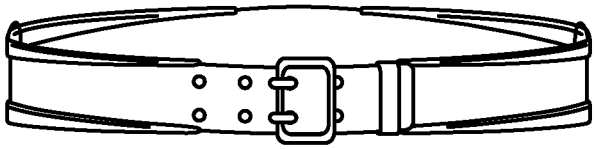
FIG. 15 shows an exemplary belt to be utilized in conjunction with the load bearing and/or suspension system according to the present disclosure.

FIG. 15 shows an exemplary belt to be utilized in conjunction with the load bearing and/or suspension system according to the present disclosure.

Figure 16:
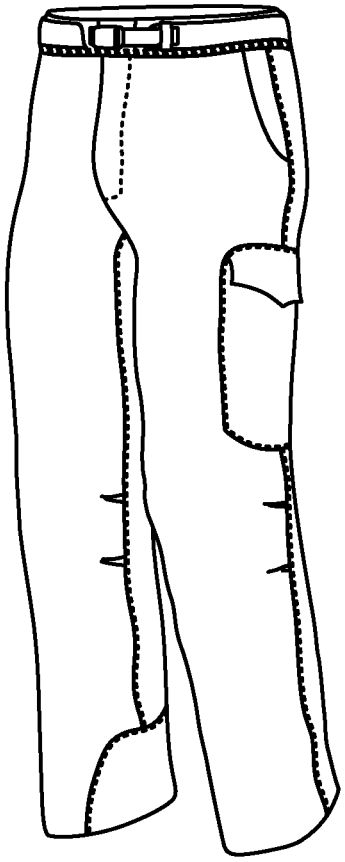
FIG. 16 shows an exemplary pair of pants and belt to be utilized in conjunction with the load bearing and/or suspension system according to the present disclosure.

FIG. 16 shows an exemplary pair of pants and belt to be utilized in conjunction with the load bearing and/or suspension system according to the present disclosure.

Figure 17A:
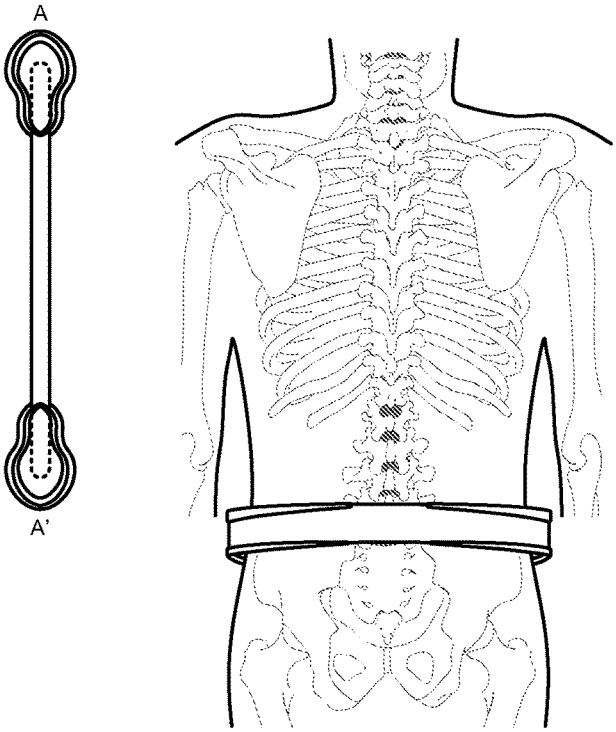
FIGS. 17A-17B illustrate the placement of an exemplary belt, according to the present disclosure, in relative to a wearer's skeletal structure.
Figure 17B:
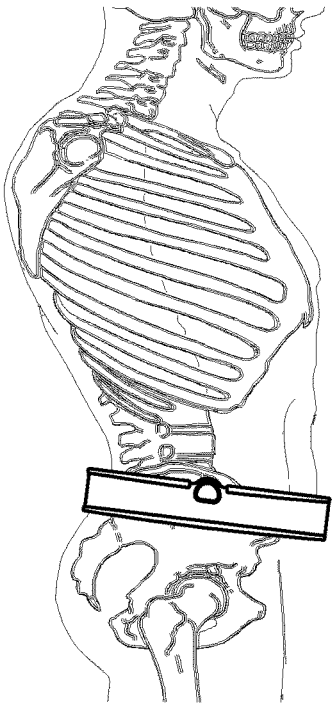
Figure 18A:
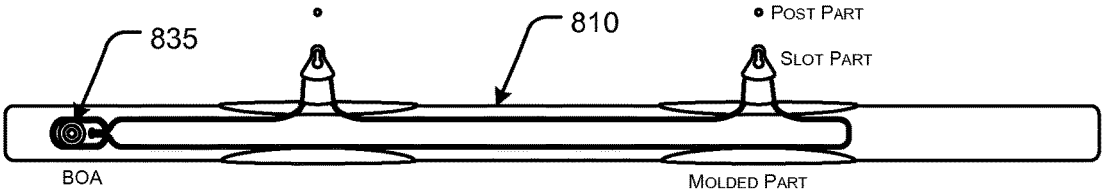
FIGS. 18A-18C show various views of an exemplary belt and belt padding elements to be utilized in conjunction with the load bearing and/or suspension system according to the present disclosure.
Figure 18B:
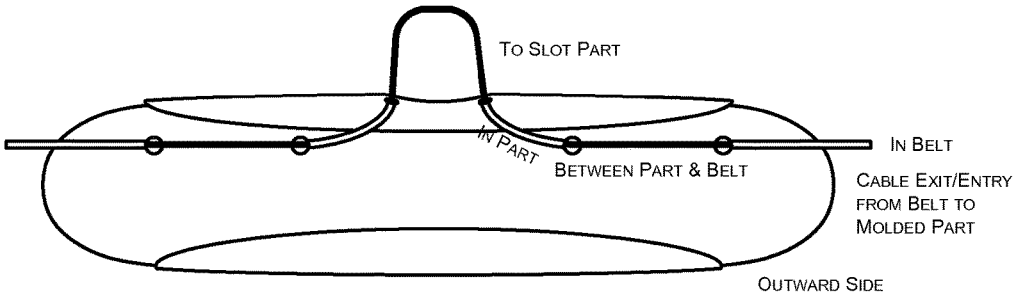
Figure 18C:
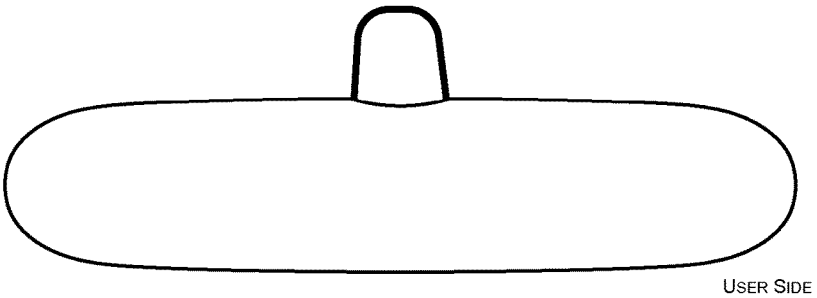
Figure 19A:
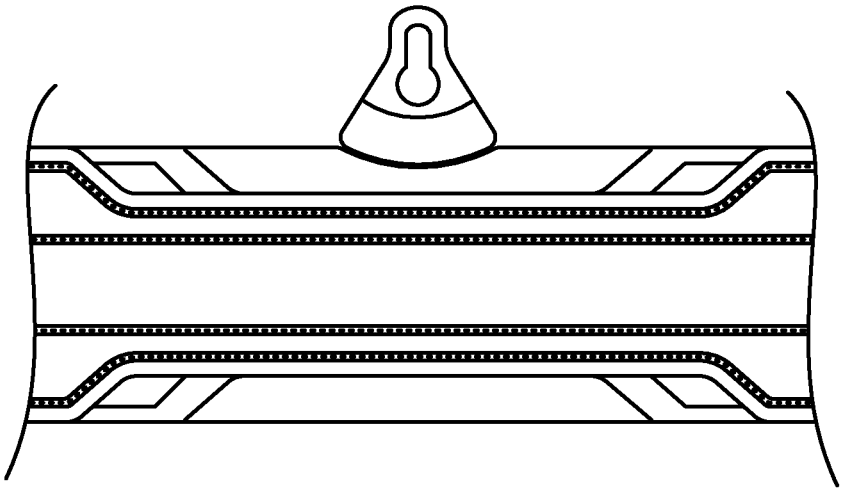
FIGS. 19A-19B show an exemplary belt and attachment means to be utilized in conjunction with the load bearing and/or suspension system according to the present disclosure.
Figure 19B:
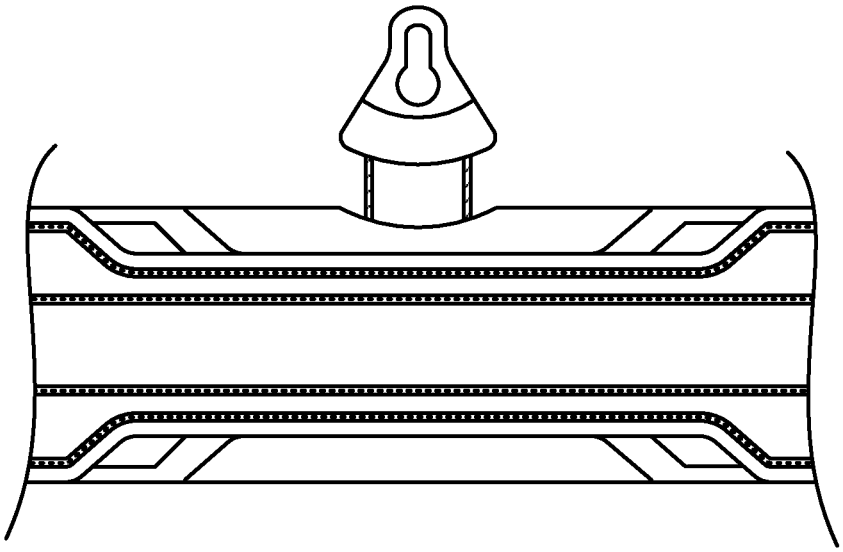
Figure 20:
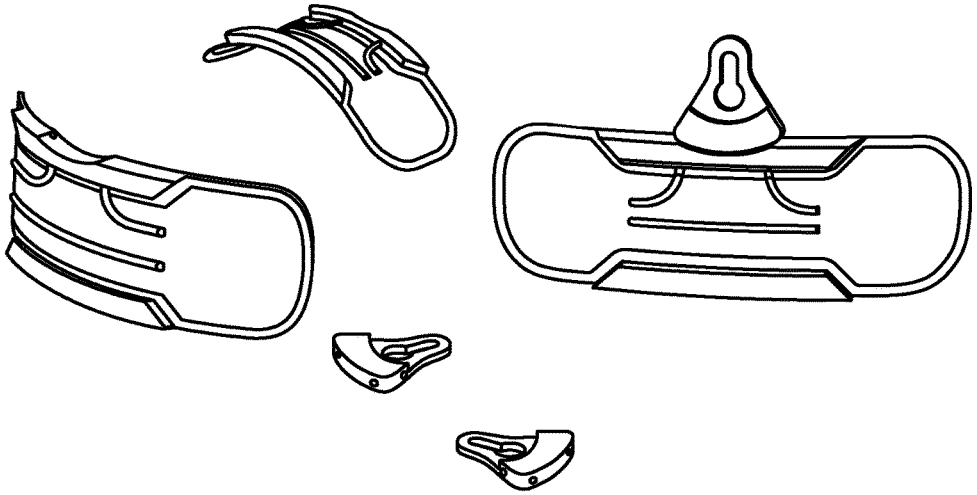
FIG. 20 shows various views of an exemplary belt padding element and attachment means to be utilized in conjunction with the load bearing and/or suspension system according to the present disclosure.
Figure 21:
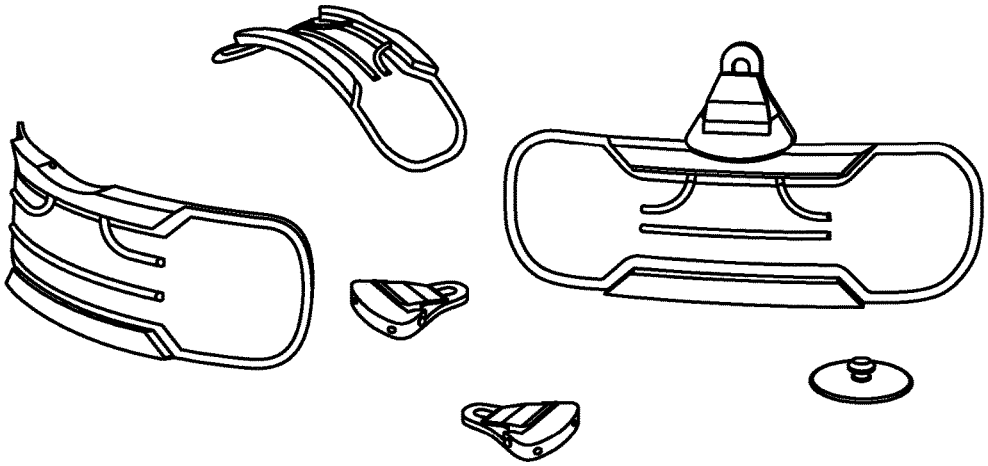
FIG. 21 shows various views of an exemplary belt padding element and an additional embodiment of an attachment means to be utilized in conjunction with the load bearing and/or suspension system according to the present disclosure.
Figure 22:
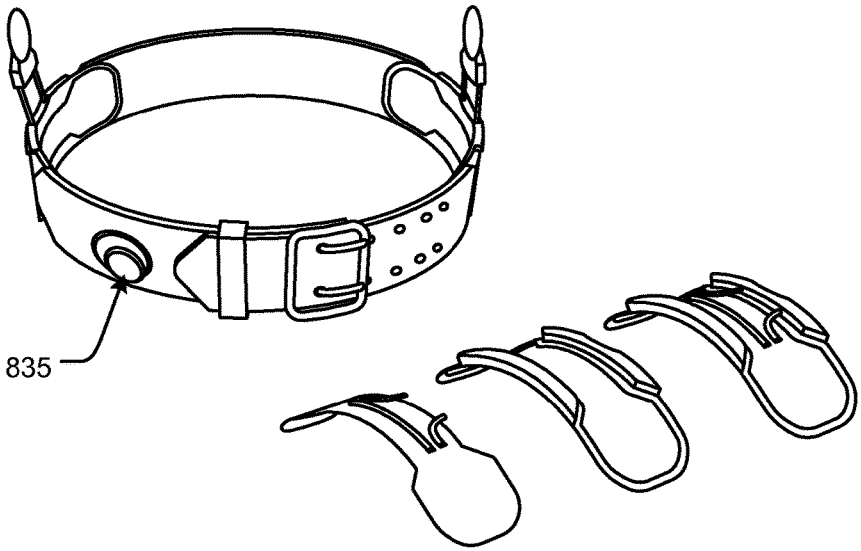
FIG. 22 shows an exemplary belt, belt padding element, and attachment means to be utilized in conjunction with the load bearing and/or suspension system according to the present disclosure.
Figure 23:
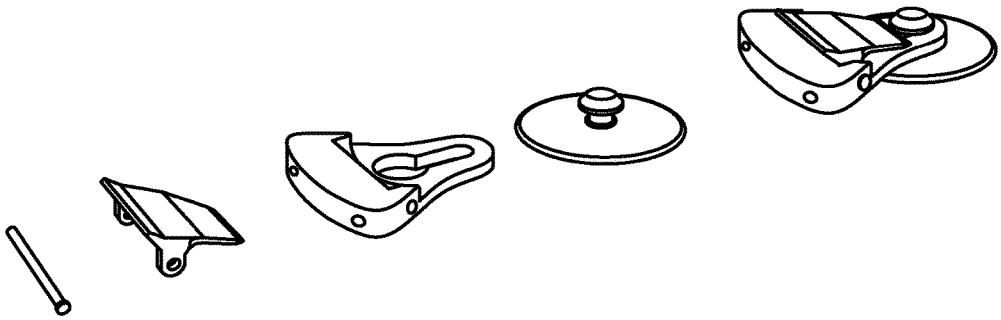
FIG. 23 shows an exemplary attachment means to be utilized in conjunction with the load bearing and/or suspension system according to the present disclosure.
Figure 24A:
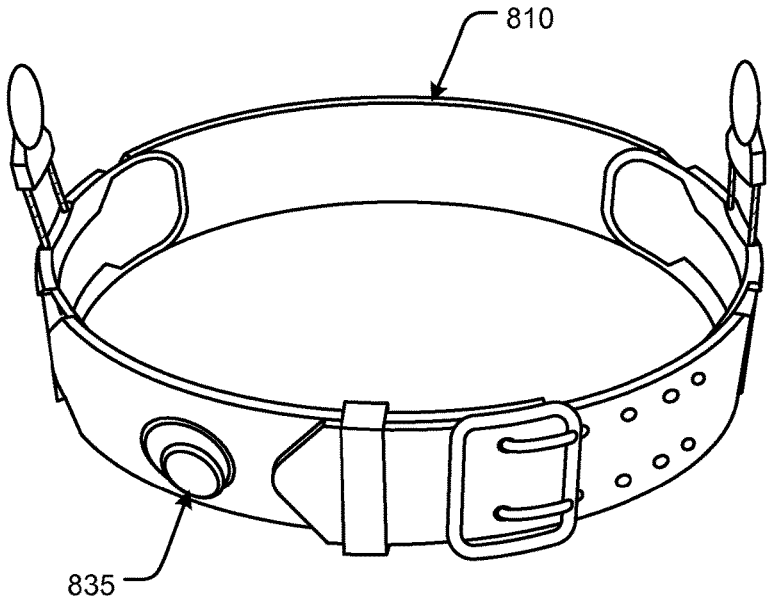
FIG. 24A shows front perspective view of an exemplary belt, belt padding element, and attachment means to be utilized in conjunction with the load bearing and/or suspension system according to the present disclosure.
Figure 24B:
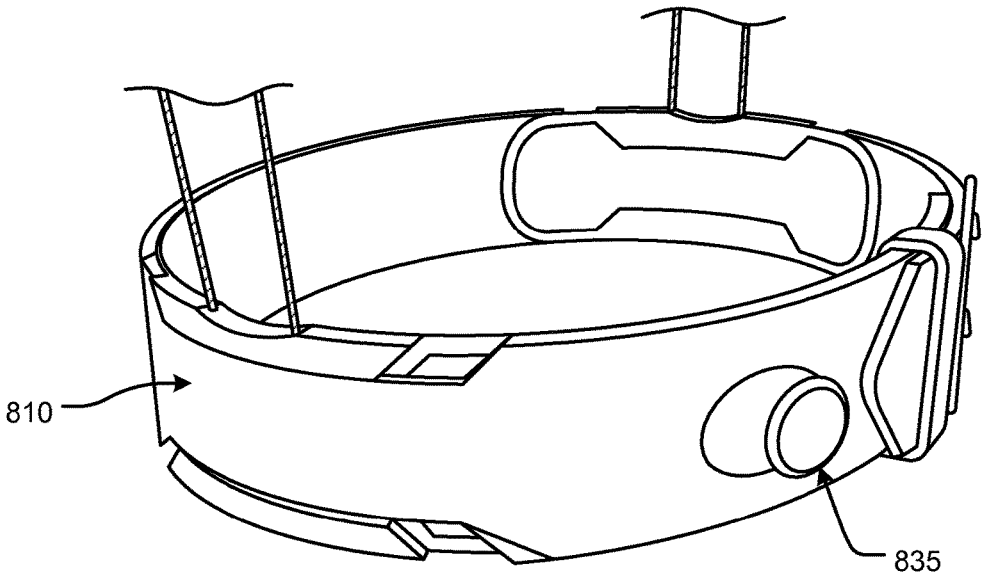
FIG. 24B shows side perspective view of an exemplary belt, belt padding element, and attachment means to be utilized in conjunction with the load bearing and/or suspension system according to the present disclosure.
Figure 25A:
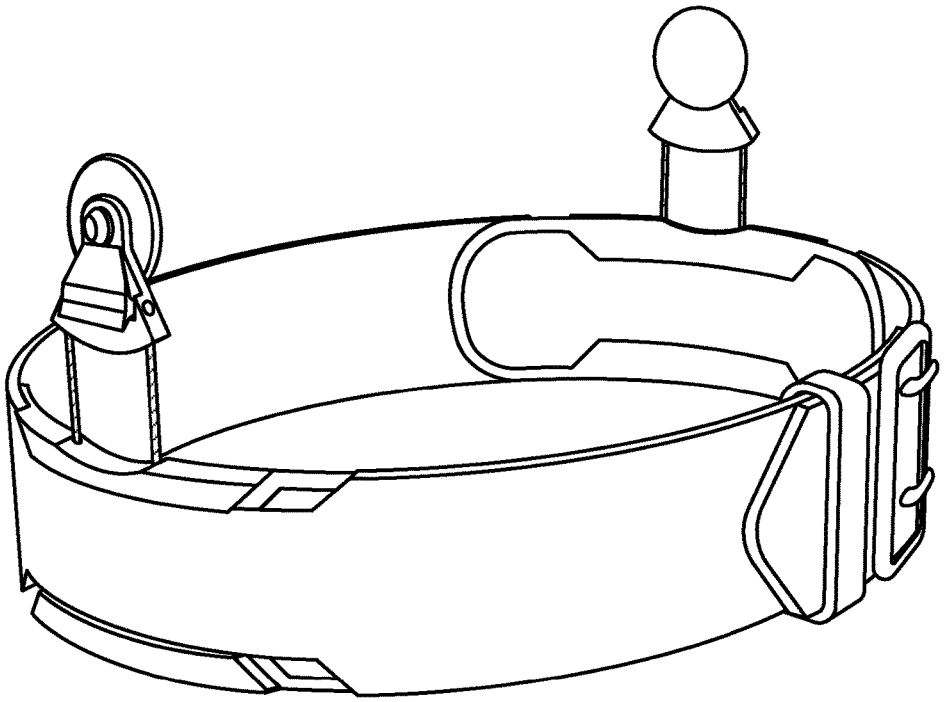
FIG. 25A shows side perspective view of an exemplary belt, belt padding element, and attachment means to be utilized in conjunction with the load bearing and/or suspension system according to the present disclosure.
Figure 25B:
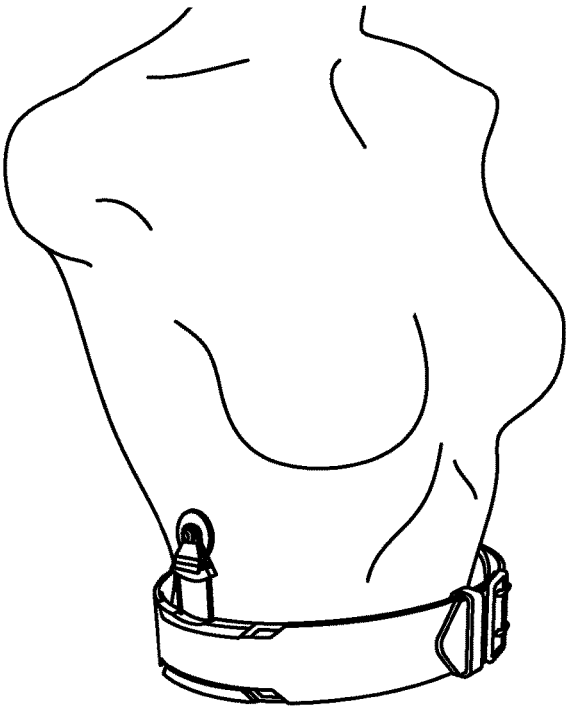
FIG. 25B shows side perspective view of an exemplary belt, belt padding element, and attachment means position around a wearer's waist, according to the present disclosure.
Figure 26A:
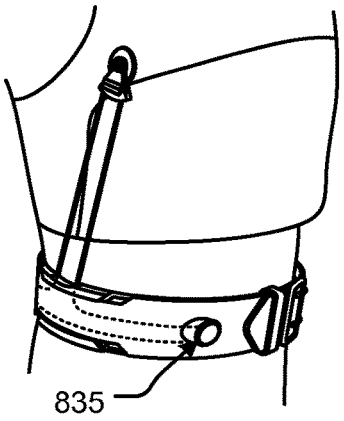
FIGS. 26A-26C show an exemplary load bearing and/or suspension system according to the present disclosure, as worn by a user.
Figure 26B:
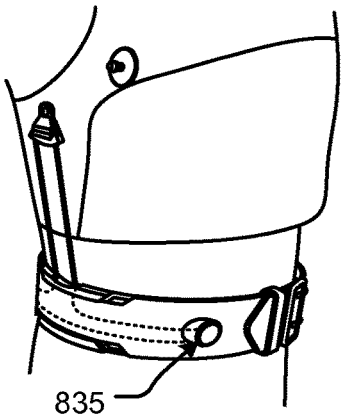
Figure 26C:
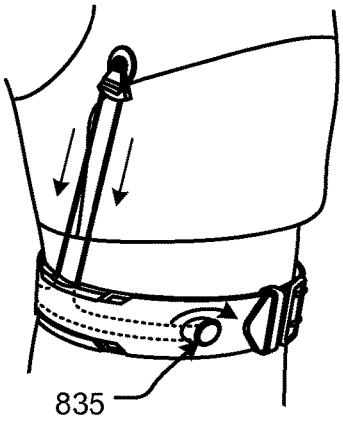

FIGS. 17A-17B illustrate the placement of an exemplary belt, according to the present disclosure, in relative to a wearer's skeletal structure.

FIGS. 18A-26C show an exemplary load bearing and/or suspension system according to the present disclosure, wherein an adjustment dial, or other retracting device, is attached to or imbedded within a portion of the belt.

Figure 27A:
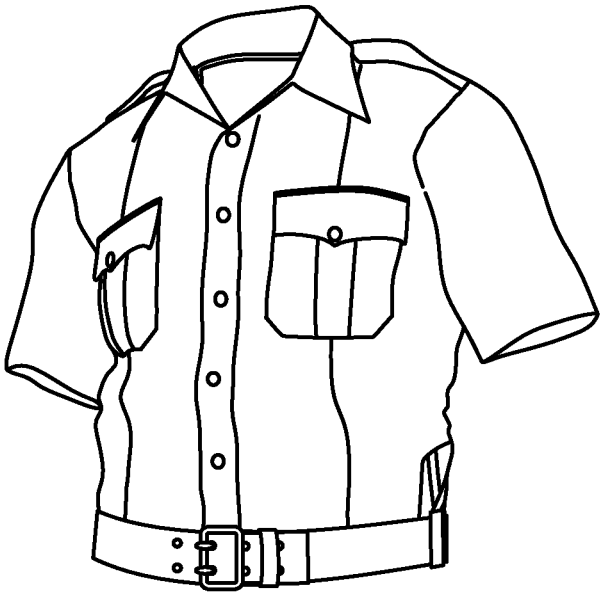
FIGS. 27A-27C show various components of an exemplary embodiment of the load bearing and/or suspension system according to the present disclosure.
Figure 27B:
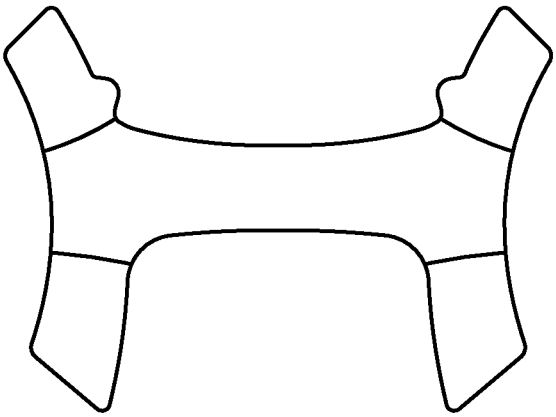
Figure 27C:
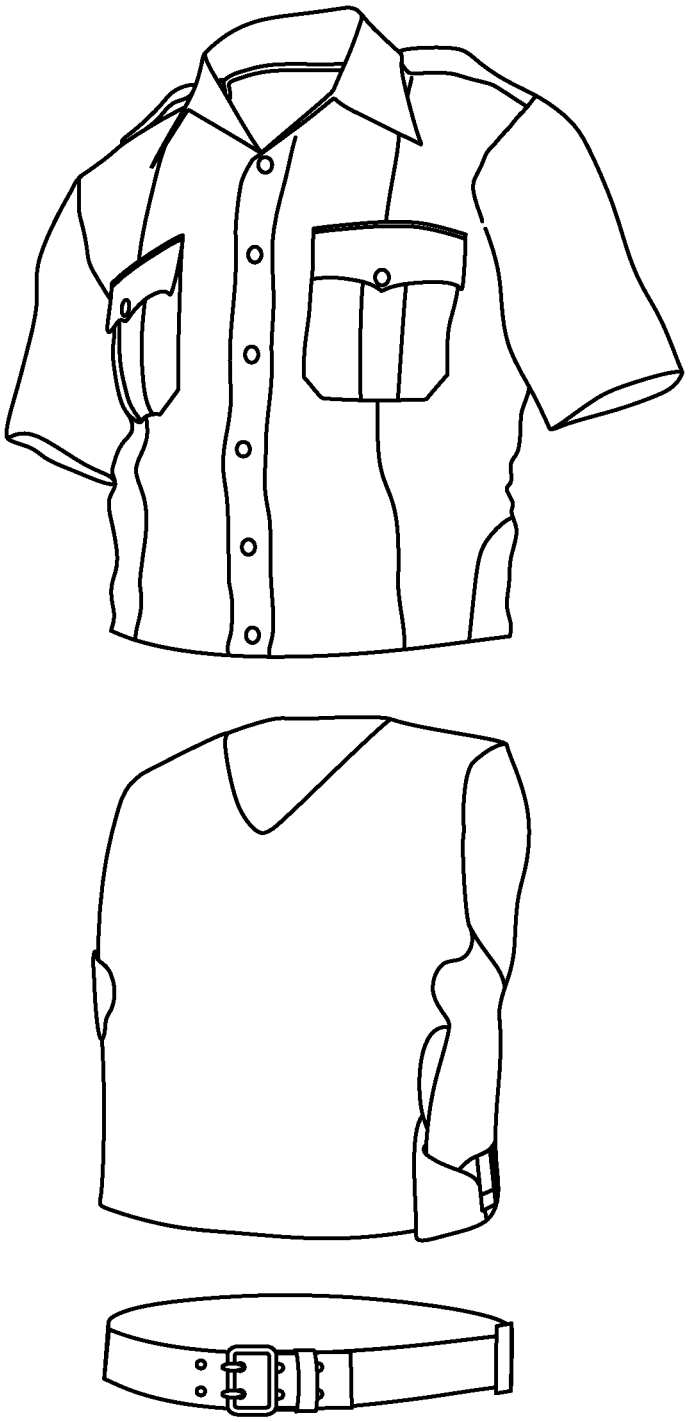

FIGS. 27A-27C show various components of an exemplary embodiment of the load bearing and/or suspension system according to the present disclosure.

Figure 28A:
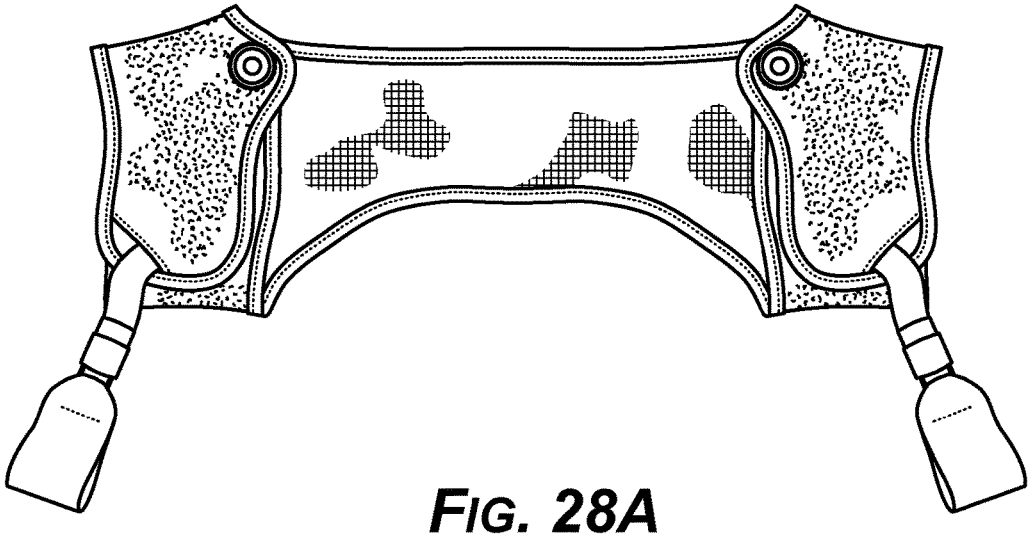
FIGS. 28A-28C show an exemplary embodiment of a harness to be utilized in connection with the load bearing and/or suspension system according to the present disclosure.
Figure 28B:
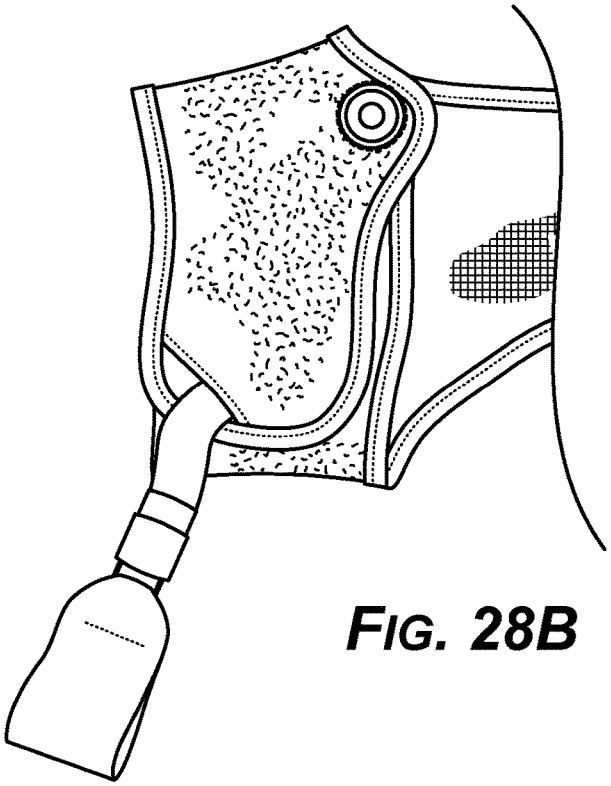
Figure 28C:
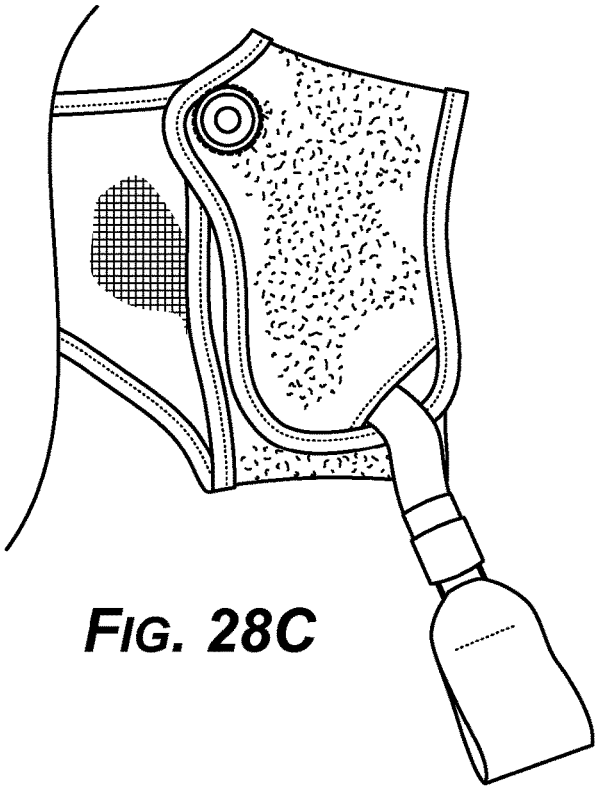

FIGS. 28A-28C show an exemplary embodiment of a harness to be utilized in connection with the load bearing and/or suspension system according to the present disclosure.

Figure 29:
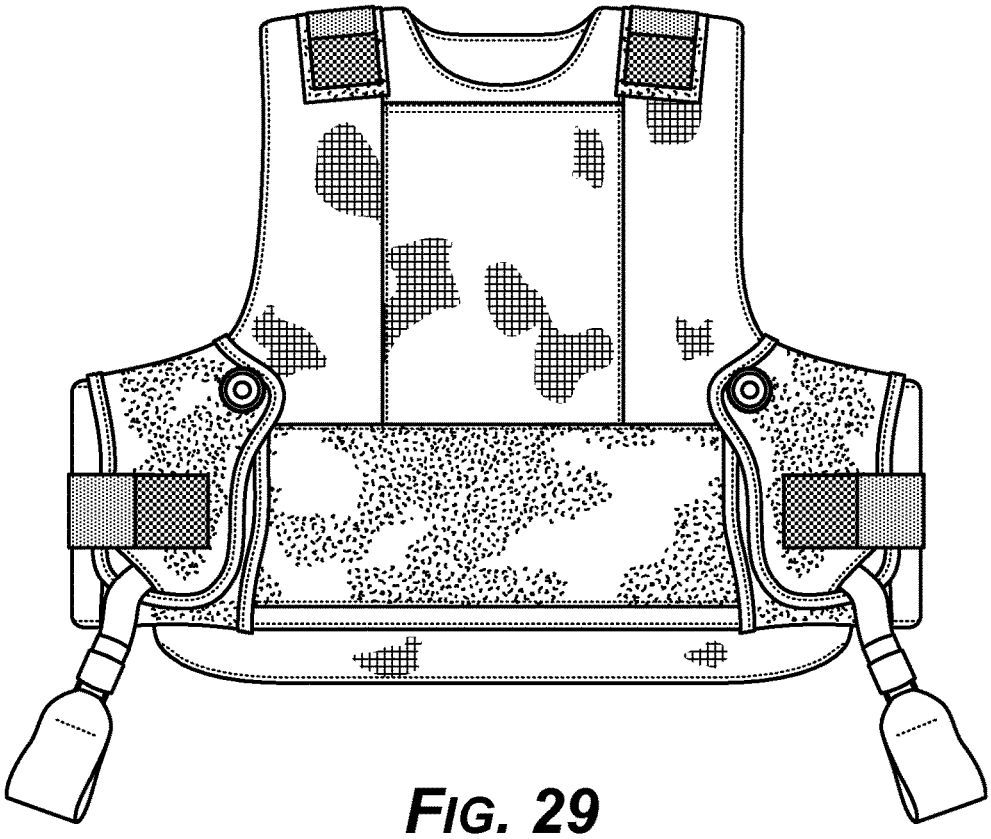
FIG. 29 shows an exemplary embodiment of a harness to be utilized in connection with the load bearing and/or suspension system according to the present disclosure.

FIG. 29 shows an exemplary embodiment of a harness to be utilized in connection with the load bearing and/or suspension system according to the present disclosure.

Figure 30:
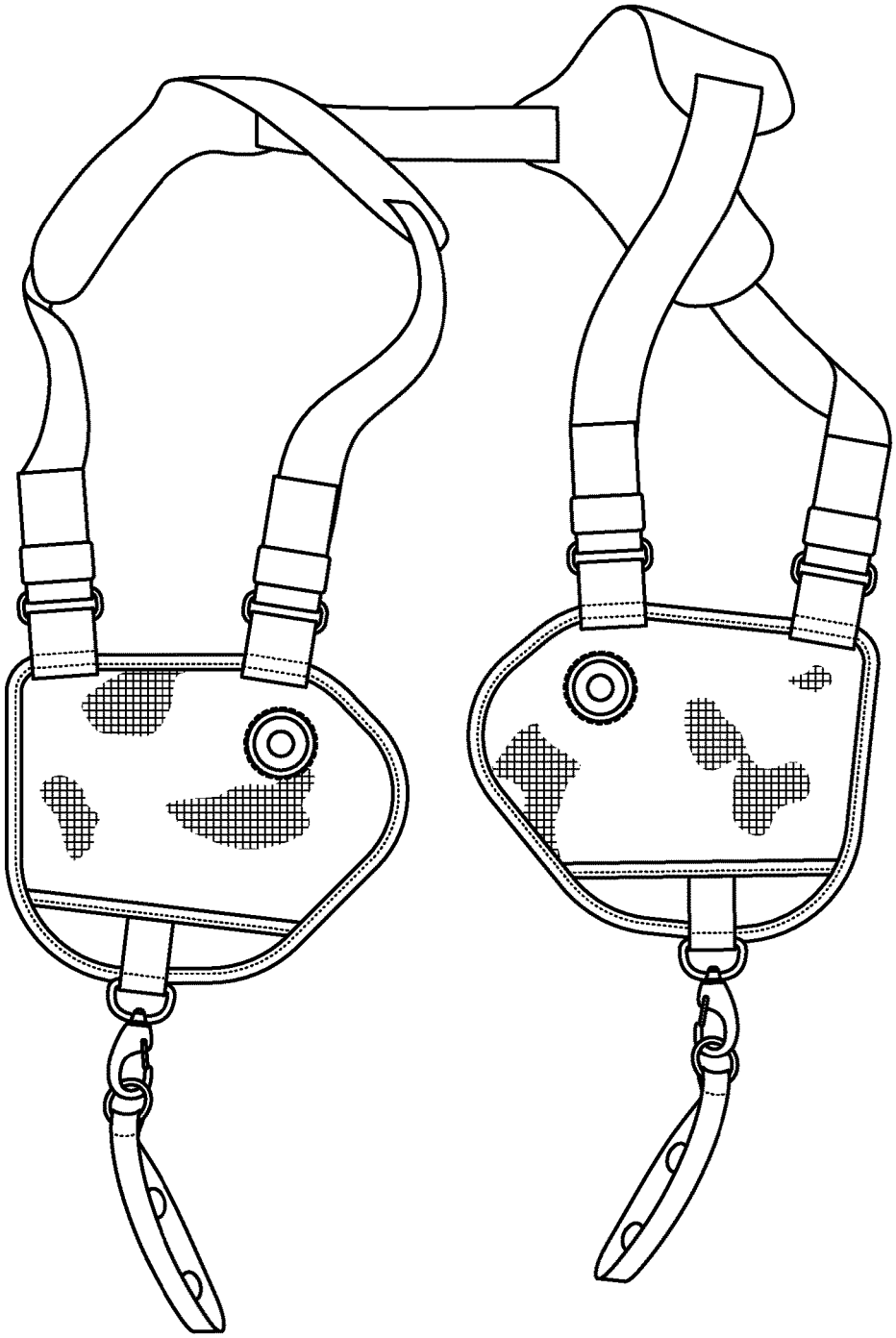
FIG. 30 shows an exemplary embodiment of a load bearing and/or suspension system according to the present disclosure.

FIG. 30 shows an exemplary embodiment of a load bearing and/or suspension system according to the present disclosure.

FIGS. 31-34C show various components of an exemplary embodiment of a load bearing and/or suspension system 800, according to the present disclosure. As illustrated in FIGS. 31-34C, the load bearing and/or suspension system 800 includes a harness element 830. The harness element 830 is generally shaped so as to form a double V, double Y, or double T and is formed so as to extend between a wearer's shoulders and extends such that a portion fits or drapes over at least a portion of the wearer's shoulders. In various exemplary embodiments, the harness element 830 is formed so as to pass over each of the wearer's shoulders, and extend between two shoulder sections, behind the wearer's neck, between the wearer's shoulder blades. Each shoulder section passes generally over the front and rear of the wearer's shoulders, and joins the suspension members 870, located generally below the wearer's armpit, from which the webbing segments 833 extend.

In certain exemplary embodiments, as illustrated, the harness element 830 comprises two harness element portions joined by a harness joining element 831. If included, the harness joining element 831 may comprise a portion of elastic or not elastic material.

In various exemplary embodiments, the harness element 830 comprises a fabric, webbing, mesh, or reinforced fiber material that is flexible enough to drape over the shoulders of the wearer and strong enough to support at least a portion of a load while in tension.

In various exemplary, nonlimiting embodiments, four harness straps 832 extend from the harness element 830. Two of the harness straps 832 extend so as to be draped over at least a portion of a wearer's chest, while two of the harness strap 832 extend over a portion of the wearer's back.

In certain exemplary embodiments, the harness straps 832 are integral portions of the harness element 830, which merely extend portions of the harness element 830. Alternatively, as illustrated, the harness straps 832 comprise separate strap elements, which are attached or coupled, proximate a first or initial end of each harness strap 832, to the harness element 830.

A second or terminal end of each pair of forward and rearward draping harness straps 832 is attached or coupled to a suspension member 870. In various exemplary embodiments, a second or terminal end of each harness strap 832 is attached or coupled directly to the suspension member 870. Alternatively, each harness strap 832 is attached or coupled, proximate the second or terminal end, to the suspension member 870, via a ring or loop 862. By attaching or coupling each harness strap 832 via a ring or loop 862, the length of each harness strap 832 may independently be adjusted, relative to the suspension member 870.

The suspension member 870 comprises a portion of material extending from a pair of harness straps 832. As illustrated most clearly in FIGS. 34A-34C, when worn, the suspension member 870 is suspended from the harness straps 832 so as to be positioned under the arm of the wearer, with a first harness strap 832 extending over a front portion of the wearer shoulder and a second harness strap 832 extending over a rear portion of the wearer's shoulder.

The suspension member 870 provides a platform or portion of material for attachment or coupling of the harness element 830 and harness straps 832 to an adjustable webbing segment 833, on either side of a wearer. In various exemplary, nonlimiting embodiments, the suspension member 870 comprises a first layer of material 871 and a second layer of material 872. In these exemplary embodiments, the second layer of material 872 is positioned atop at least a portion of the first layer of material 871 is at least partially attached or coupled to the first layer of material 871 to form an interior cavity between at least a portion of a top surface of the first layer of material 871 and at least a portion of a bottom surface of the second layer of material 872. At least one open area 873 is provided between the first layer of material 871 and the second layer of material 872, so as to allow at least a portion of the webbing segment 833 to be introduced into the cavity formed between the first layer of material 871 and the second layer of material 872.

Alternatively, the suspension member 870 may comprise a single layer of material.

In embodiments wherein the suspension member 870 comprises a first layer of material 871 and a second layer of material 872, at least one aperture is formed through the second layer of material 872. In this manner, at least a portion of the webbing segment 833 can be introduced, via the at least one open area 873, into the cavity formed between the first layer of material 871 and the second layer of material 872 and inserted through the at least one aperture. In this manner, at least a free end portion of the webbing segment 833 is introduced into the cavity and inserted through the aperture, so as to be accessible on a top surface of the second layer of material 872.

A ladder lock buckle 865 is attached or coupled atop a top surface of the suspension member 870. In various exemplary embodiments, the ladder lock buckle 865 is attached or coupled to the suspension member 870 by inserting a portion of attachment webbing 835 through an aperture in the ladder lock buckle 865 and releasably or permanently attaching or coupling, such as, for example, by stitching, a portion of the attachment webbing 835 to the suspension member 870.

A separate portion of webbing segment 833 extends from a first end to a second end and a portion of webbing segment 833 is attached or coupled to each portion of attachment webbing 835 (and each suspension member 870) by being interlaced in a respective ladder lock buckle 865.

Thus, when the first or free end of the webbing segment 833 is inserted through the aperture, the free end of the webbing segment 833 extends from the second layer of material 872 and is appropriately looped or interlaced through the ladder lock buckle 865 so that when the free end of the webbing segment 833 is pulled, the second end of the webbing segment 833 is drawn toward the ladder lock buckle 865.

Figure 31:
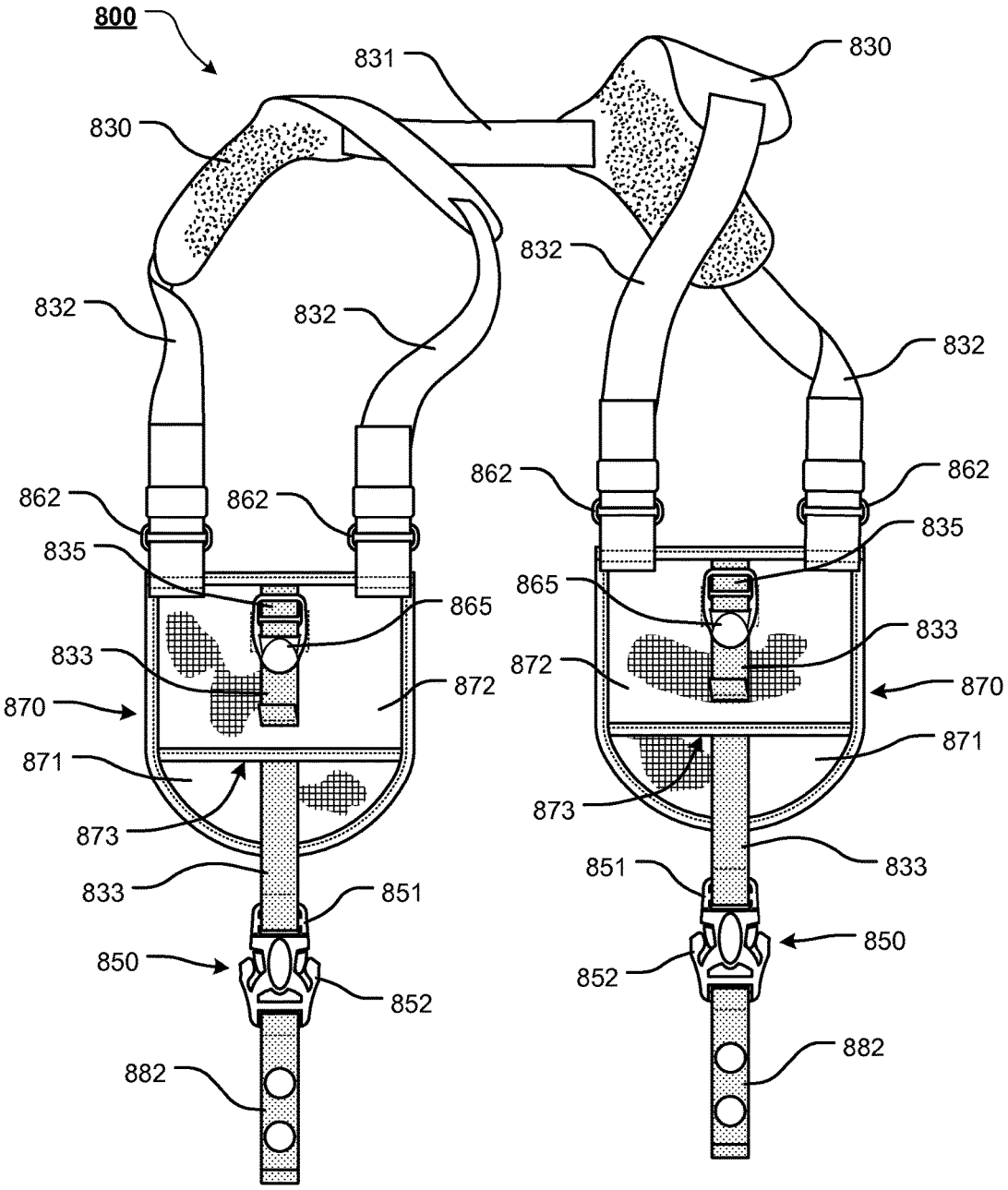
FIG. 31 shows an exemplary embodiment of a load bearing and/or suspension system according to the present disclosure.
Figure 32:
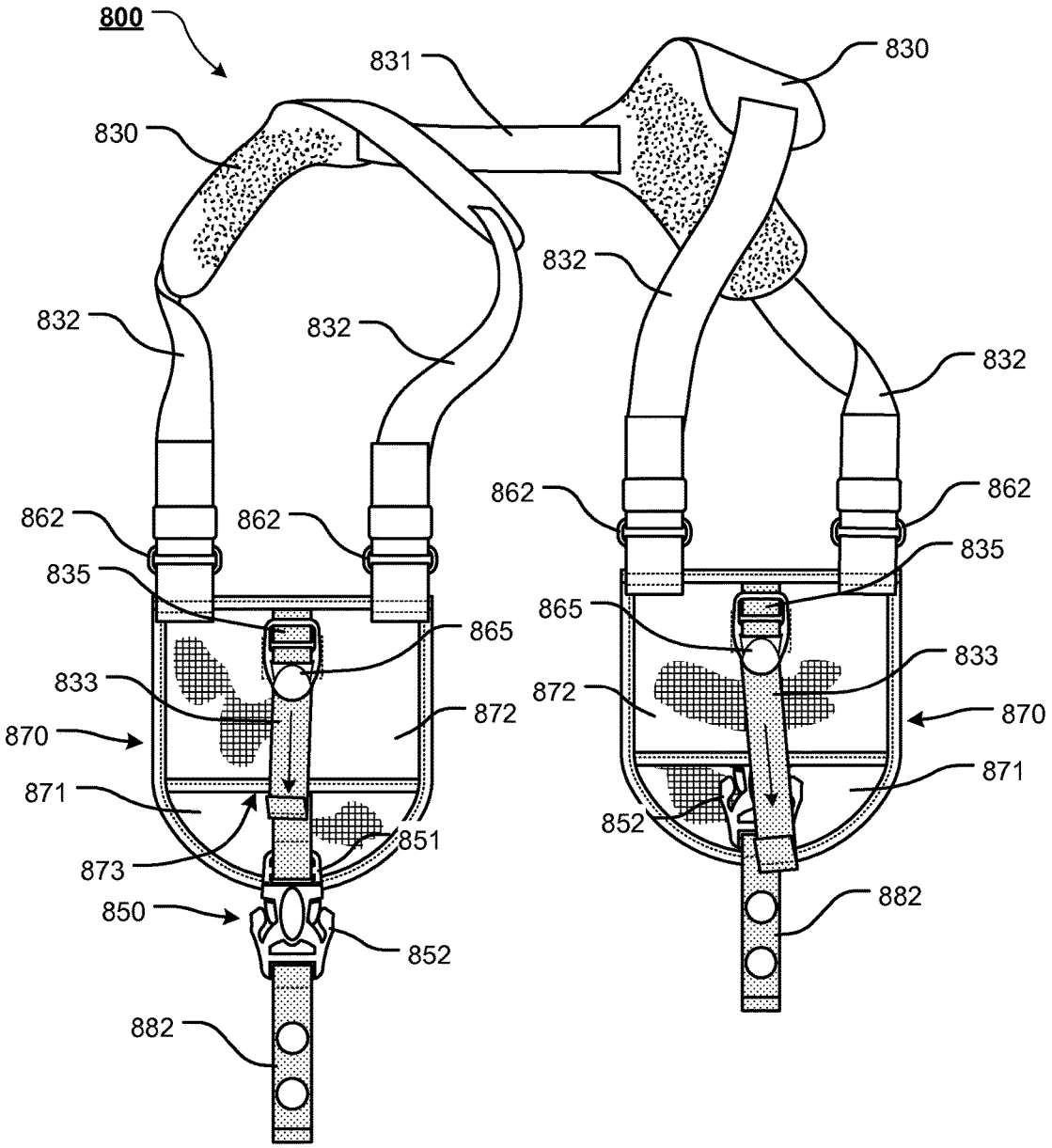
FIG. 32 shows an exemplary embodiment of a load bearing and/or suspension system according to the present disclosure.

In various exemplary embodiments, as illustrated in FIGS. 31-32, the second end of each webbing segment 833 is releasably or permanently attached or coupled to a first mating portion of a releasable buckle 850. Generally, the releasable buckle comprises a male buckle portion 851 and a female buckle portion 852. It should be understood that either the male buckle portion 851 or the female buckle portion 852 may be attached or coupled to the second end of the webbing segment 833.

A belt attachment element 882 is releasably or permanently attached or coupled to a second mating portion of the releasable buckle 850. The belt attachment element 882 is capable of being permanently or releasably attached or coupled to a portion of a wearer's belt. In various exemplary embodiments, the belt attachment element 882 comprises a mating attachment means, such as, for example, amish buttons, male/female snap-release buckles, Velcro or other hook-and-loop fasteners, a corresponding button and buttonhole, mating snaps, hook-and-eye closures, or other fastening means for removably interlacing, attaching, or coupling the belt attachment element 882 to a wearer's belt.

Generally, the belt attachment element 882 comprises any loop or portion of material, clip, clamp, or other known or later developed element or device that can be permanently or releasably attached or coupled to a portion of a wearer's belt. By including a releasable buckle 850 between the webbing segment 833 and the belt attachment element 882, the belt attachment element 882 may remain attached or coupled to the wearer's belt (or formed as an integral portion of the wearer's belt) and releasably attached or coupled to the webbing segment 833, when desired. Then, to release the belt from the webbing segment 833, the wearer need only release the releasable buckles 850.

Figure 33:
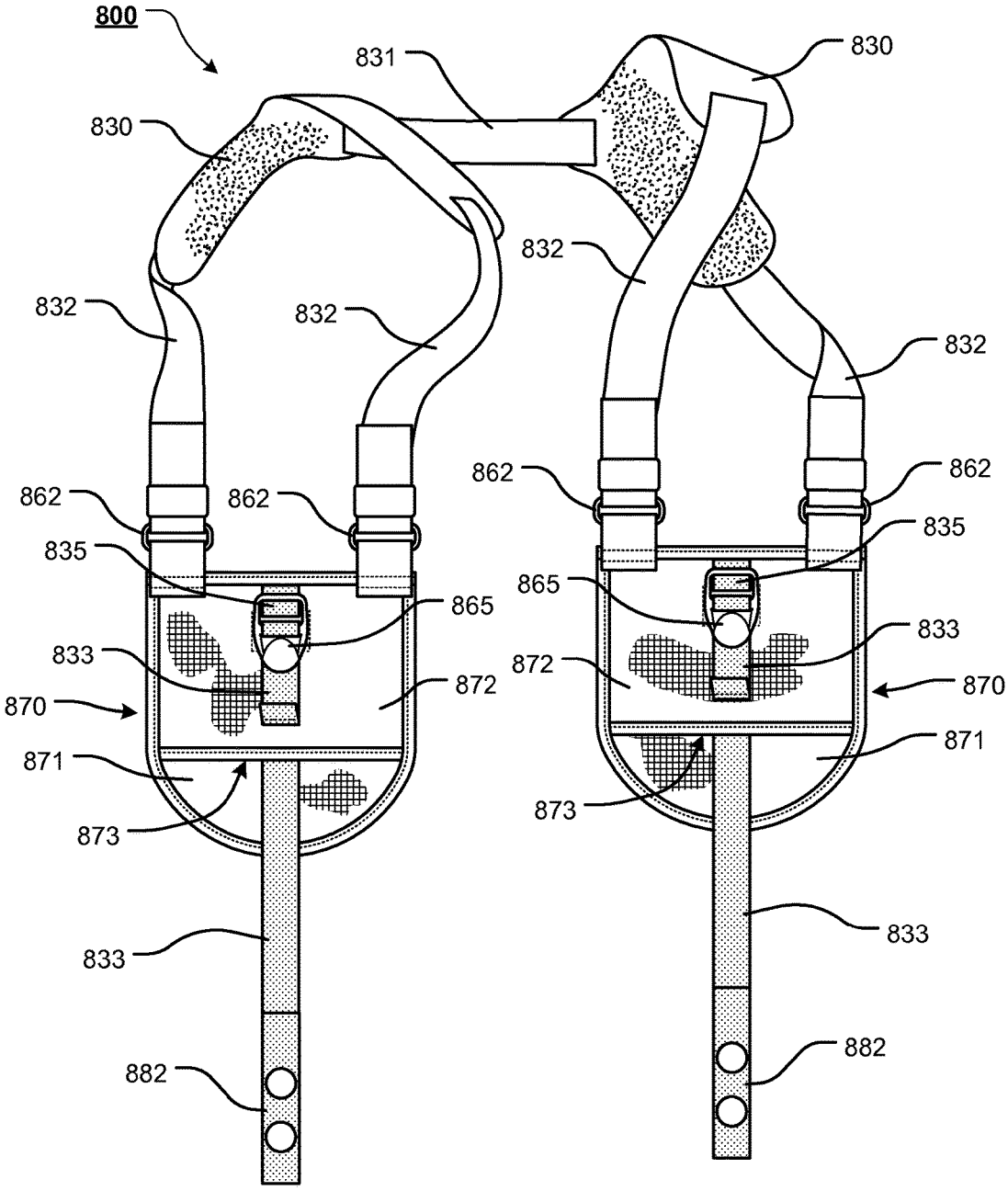
FIG. 33 shows an exemplary embodiment of a load bearing and/or suspension system according to the present disclosure.
Figure 34A:
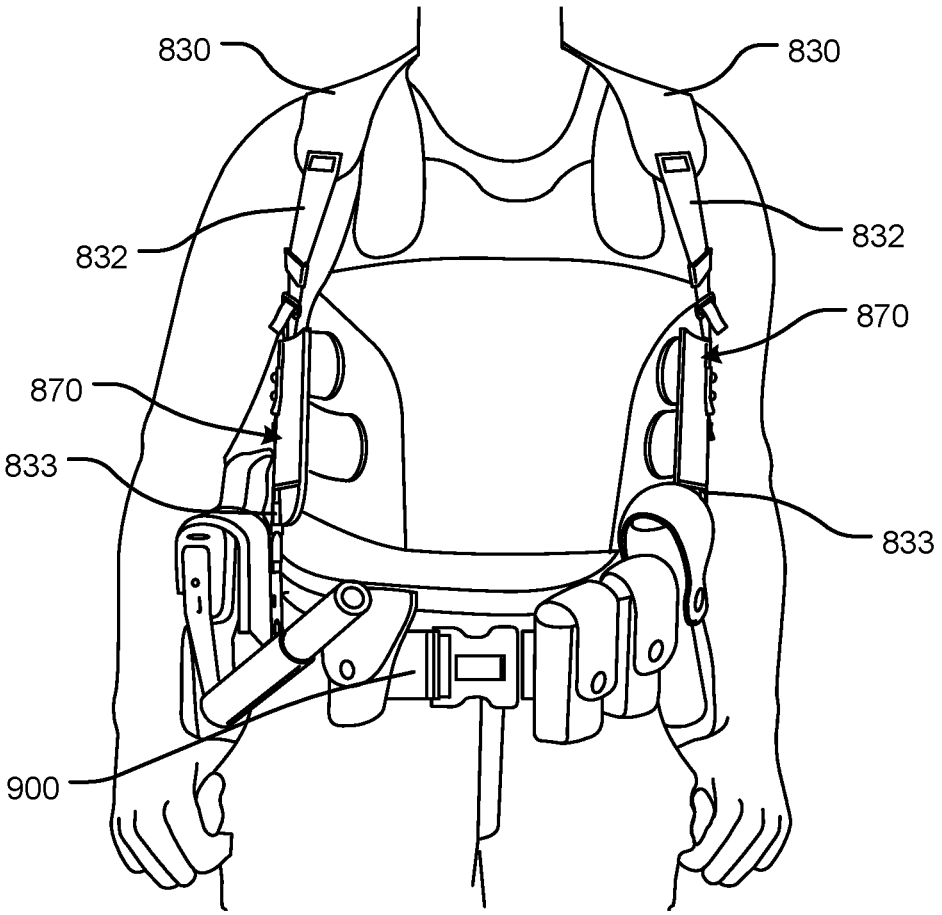
FIG. 34A shows an exemplary load bearing and/or suspension system according to the present disclosure, as worn by a user.
Figure 34B:
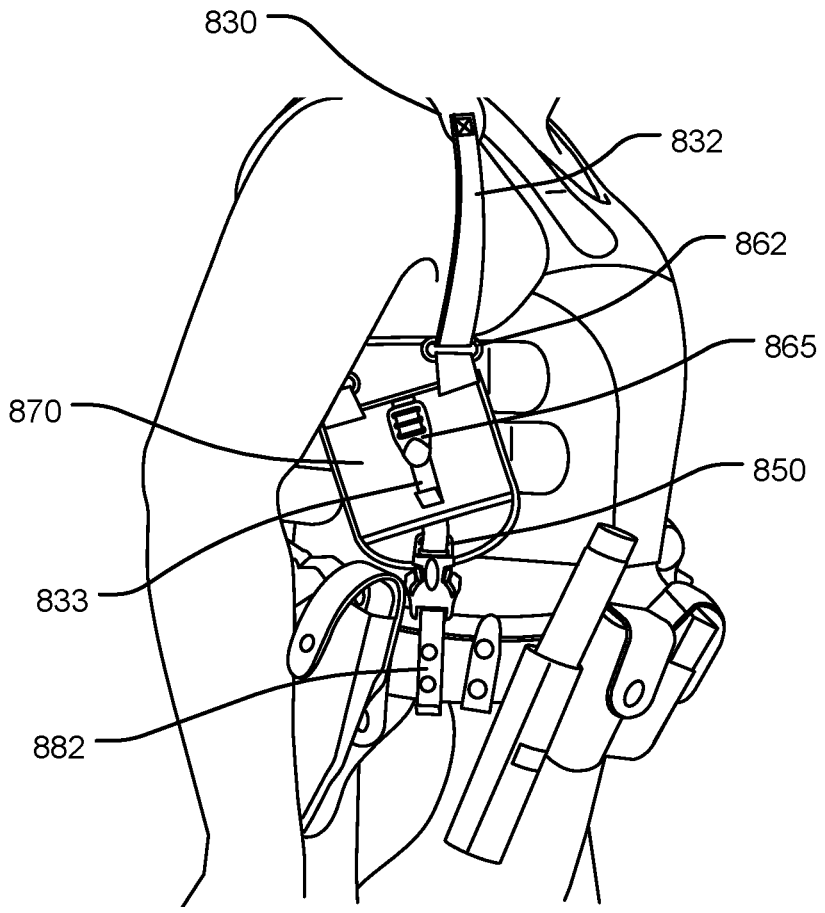
FIG. 34B shows an exemplary load bearing and/or suspension system according to the present disclosure, as worn by a user.
Figure 34C:
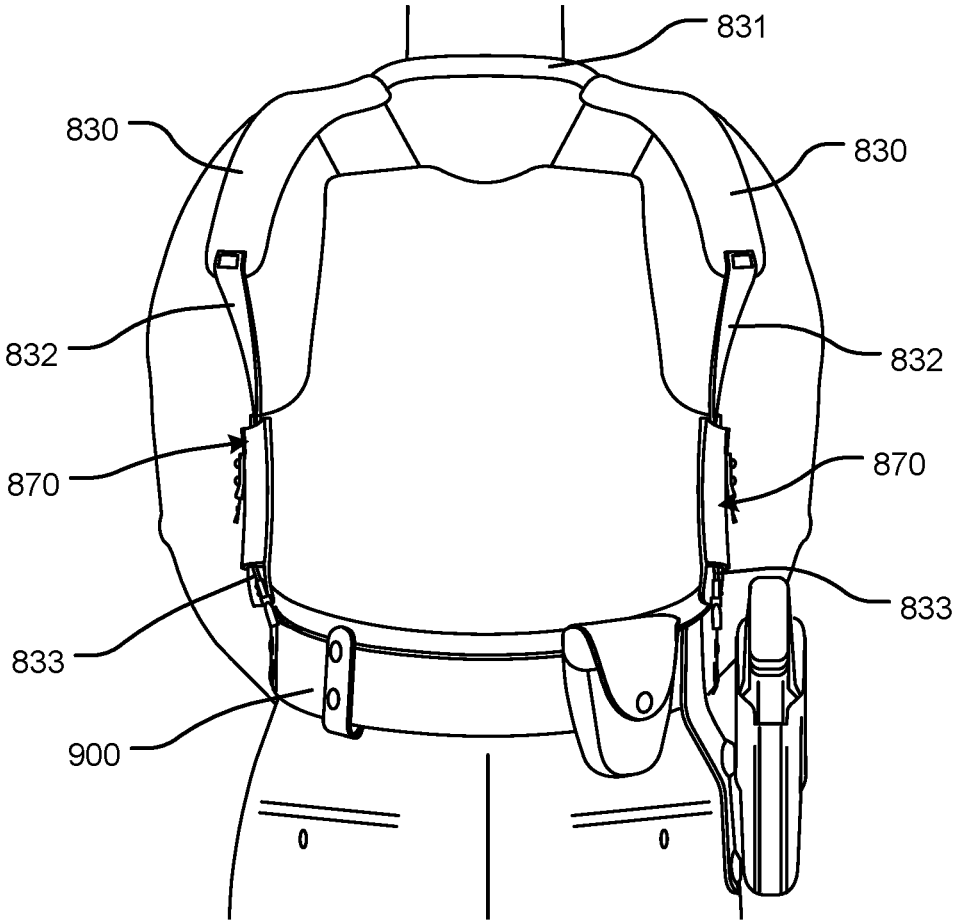
FIG. 34C shows an exemplary load bearing and/or suspension system according to the present disclosure, as worn by a user.

In certain exemplary embodiments, as illustrated in FIG. 33, the releasable buckles 850 are not included and the belt attachment element 882 is formed as an integral component of the webbing segment 833 or is attached or coupled to the webbing segment 833.

When the load bearing and/or suspension system 800 is worn, corresponding belt attachment element 882 are located in an area of the wearer's belt that will be positioned proximate sides of the wearer. The corresponding belt attachment element 882 are appropriately attached or coupled to the wearer's belt and, as illustrated most clearly in FIG. 32, the free or first end portions of the webbing segments 833 are pulled, drawing the belt attachment element 882 toward the ladder lock buckles 865, shortening the distance between the ladder lock buckles 865 and the belt attachment element 882, and initially removing any slack in the webbing segments 833 between the belt attachment element 882 and the ladder lock buckles 865. If the free or first end portions of the webbing segments 833 continue to be pulled, the webbing segments 833 continue to be urged through the ladder lock buckles 865, further shortening the length of the webbing segment 833 between the ladder lock buckles 865 and the belt attachment element 882 and drawing the wearer's belt toward the ladder lock buckles 865. Once excess slack is removed from the webbing segments 833 and as the belt attachment element 882 and further drawn toward the ladder lock buckles 865, weight of the wearer's belt is transitioned to the harness element 830. This at least some, if not all, of the weight of the wearer's belt from the wearer's hips and transitions the weight to the wearer's shoulders.

It should be appreciated that the ladder lock buckles 865 can be manipulated to release the webbing segments 833, so that an effective length of the webbing segments 833 can be manipulated by the wearer.

Manipulating the effective length of the webbing segments 833 can be useful for distributing a desired weight between the wearer's belt (and the wearer's hips) and the harness element 830 (and the wearer's shoulders).

In various exemplary, non-limiting embodiments, all or portions of the harness 830, the harness strap 832, the attachment webbing 835, and/or the webbing segment 833 may be made of a fabric or other material, such as, for example, woven fabrics, canvas, acrylics, sheet fabrics, films, nylon, spandex, vinyl, Polyvinyl Chloride (PVC), neoprene, or the like. Additionally, all or portions of the harness 830, the harness strap 832, the attachment webbing 835, and/or the webbing segment 833 may be made of any flexible and/or elastic material and may stretch. Alternatively, all or portions of the harness 830, the harness strap 832, the attachment webbing 835, and/or the webbing segment 833 may be formed from multiple, similar or dissimilar materials. In various exemplary, non-limiting embodiments, the harness 830, the harness strap 832, the attachment webbing 835, and/or the webbing segment 833 may be water-resistant or may include a cushion material.

It should be appreciated that the terms fabric and material are to be given their broadest meanings and that the particular fabric(s) or material(s) used to form the harness 830, the harness strap 832, the attachment webbing 835, and/or the webbing segment 833 is a design choice based on the desired appearance and/or functionality of the load bearing and/or suspension system 800.

It should also be appreciated that a more detailed explanation of the considerations for selecting the specific types and sizes of webbing material, buckles, and/or attachment devices used for the load bearing and/or suspension system 800, instructions regarding how to attach or coupled the load bearing and/or suspension system 800 to a belt, methods for using the load bearing and/or suspension system 800, once attached or coupled to a belt, and certain other items and/or techniques necessary for the implementation and/or operation of the various exemplary embodiments of the present invention are not provided herein because it is believed that the level of description provided herein is sufficient to enable one of ordinary skill in the art to understand and practice the present disclosure, as described.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A load bearing and/or suspension system, comprising:

a harness element;

harness straps extending from said harness element;

a pair of suspension members, wherein each suspension member extends from a pair of harness straps, and wherein each suspension member comprises a first layer of material and a second layer of material, wherein at least a portion of said second layer of material is at least partially attached or coupled to at least a portion of said first layer of material to form at least a partial cavity between at least a portion of said first layer of material and at least a portion of said second layer of material;

a ladder lock buckle attached or coupled to each suspension member;

a pair of webbing segments, wherein at least a free end portion of a webbing segment is introduced into at least a portion of said at least partial cavity, and wherein a free end of each webbing segment interacts with one of said ladder lock buckles such that when said free end of said webbing segment is urged away from said ladder lock buckle, a second end of said webbing segment is drawn toward said ladder lock buckle; and a belt attachment element attached or coupled to said second end of said webbing segment.

2. The load bearing and/or suspension system of claim 1, wherein said harness element is shaped to form a double V, a double Y, or a double T overall shape.

3. The load bearing and/or suspension system of claim 1, wherein said harness element comprises two harness element portions joined by a harness joining element.

4. The load bearing and/or suspension system of claim 3, wherein said harness joining element comprises a portion of elastic or not elastic material.

5. The load bearing and/or suspension system of claim 1, wherein said harness straps are integrally formed portions of said harness element.

6. The load bearing and/or suspension system of claim 1, wherein said harness straps comprise separate strap elements, attached or coupled to said harness element.

7. The load bearing and/or suspension system of claim 1, wherein each harness strap is attached or coupled to a respective suspension member such that a length of each harness strap may be adjusted, relative to said respective suspension member.

8. The load bearing and/or suspension system of claim 1, wherein at least a free end portion of said webbing segment is introduced into said at least partial cavity and inserted through at least one aperture formed through said second layer of material.

9. The load bearing and/or suspension system of claim 1, wherein said ladder lock buckle is attached or coupled to said suspension member via a portion of attachment webbing that is releasably or permanently attached or coupled to a portion of said suspension member.

10. The load bearing and/or suspension system of claim 1, wherein said belt attachment element is formed as an integral component of said webbing segment.

11. The load bearing and/or suspension system of claim 1, wherein said belt attachment element is releasably attached or coupled to said webbing segment, via a releasable buckle.

12. The load bearing and/or suspension system of claim 1, wherein said belt attachment element is capable of being permanently or releasably attached or coupled to a portion of a belt.

13. The load bearing and/or suspension system of claim 1, wherein said free end of each webbing segment interacts with said ladder lock buckle by being looped or interlaced through a portion of each of said ladder lock buckles.

14. A load bearing and/or suspension system, comprising:

a harness element;

harness straps extending from said harness element;

a pair of suspension members, wherein each suspension member extends from a pair of harness straps, wherein said suspension member comprises a first layer of material and a second layer of material, wherein an interior cavity is formed between at least a portion of said first layer of material and at least a portion of said second layer of material, and wherein at least one aperture is formed through said second layer of material;

a ladder lock buckle attached or coupled to each suspension member, wherein said ladder lock buckle is attached or coupled to each of said suspension members via a portion of attachment webbing that is releasably or permanently attached or coupled to a portion of said suspension member;

a pair of webbing segments, wherein at least a free end portion of each of said webbing segments is introduced into said respective cavity and inserted through said at least one aperture formed in said second layer of material; and wherein a free end of each webbing segment interacts with one of said ladder lock buckles such that when said free end of said webbing segment is urged away from said ladder lock buckle, a second end of said webbing segment is drawn toward said ladder lock buckle; and a belt attachment element attached or coupled to said second end of said webbing segment.

15. The load bearing and/or suspension system of claim 14, wherein said harness element is shaped to form a double V, a double Y, or a double T overall shape.

16. The load bearing and/or suspension system of claim 14, wherein said harness element comprises two harness element portions joined by a harness joining element.

17. The load bearing and/or suspension system of claim 14, wherein said harness straps are integrally formed portions of said harness element.

18. A load bearing and/or suspension system, comprising:

a harness element;

harness straps extending from said harness element, wherein each harness strap is attached or coupled to a respective suspension member such that a length of each harness strap may be adjusted, relative to said respective suspension member;

a pair of suspension members, wherein each suspension member extends from a pair of harness straps, wherein said suspension member comprises a first layer of material and a second layer of material, wherein an interior cavity is formed between at least a portion of said first layer of material and at least a portion of said second layer of material, and wherein at least one aperture is formed through said second layer of material;

a ladder lock buckle attached or coupled to each suspension member, wherein said ladder lock buckle is attached or coupled to each of said suspension members via a portion of attachment webbing that is releasably or permanently attached or coupled to a portion of said suspension member;

a pair of webbing segments, wherein at least a free end portion of each of said webbing segments is introduced into said respective cavity and inserted through said at least one aperture formed in said second layer of material; and wherein a free end of each webbing segment interacts with one of said ladder lock buckles such that when said free end of said webbing segment is urged away from said ladder lock buckle, a second end of said webbing segment is drawn toward said ladder lock buckle; and a belt attachment element attached or coupled to said second end of said webbing segment.

* * * * *